US006422739B1

(12) United States Patent
Hara et al.

(10) Patent No.: US 6,422,739 B1
(45) Date of Patent: Jul. 23, 2002

(54) MAINSPRING DEVICE, TIMEPIECE, AND METHOD OF CONTROLLING THE MAINSPRING DEVICE AND THE TIMEPIECE

(75) Inventors: Tatsuo Hara; Yoshihiko Momose, both of Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/291,919

(22) Filed: Apr. 14, 1999

(30) Foreign Application Priority Data

Apr. 17, 1998 (JP) ..... 10-108248
Apr. 17, 1998 (JP) ..... 10-108249
Nov. 26, 1998 (JP) ..... 10-336338

(51) Int. Cl.[7] ..... G04B 5/24
(52) U.S. Cl. ..... 368/209
(58) Field of Search ..... 368/112, 209, 368/43, 210

(56) References Cited

U.S. PATENT DOCUMENTS 3,878,673 A * 4/1975 Meitinger ..... 368/209
4,122,663 A * 10/1978 Kock ..... 368/112
5,788,014 A * 8/1998 Saint et al. ..... 185/43

FOREIGN PATENT DOCUMENTS

CH 280369 1/1952
JP 8-5758 1/1996
JP 9-21886 1/1997

OTHER PUBLICATIONS

"Standard Timepiece Technology Reader", Japan Chapter of the U.S. Watch Society, 5th Edition, Jan. 25, 1998, pp. 160–161.

"Theoretical Horology", Grossman, pp. 69–71.

"The Horological International Correspondence", Oct. 15, 1995, vol. 36, No. 426, pp. 358–363.

* cited by examiner

*Primary Examiner*—Bernard Roskoski

(57) ABSTRACT

A timepiece, whose hands move by mechanical energy of a mainspring transmitted through a wheel train, includes a winding-up portion for accumulating energy in the mainspring, an addition and subtraction wheel train driven by addition and subtraction of accumulated energy corresponding to an amount by which the mainspring is wound up and unwound, respectively, an addition and subtraction wheel, disposed in the addition and subtraction wheel train, that rotates in correspondence with an amount by which the mainspring is wound up and unwound, and a lock mechanism actuated in response to the rotation of the addition and subtraction wheel to limit winding up and unwinding of the mainspring to a selected range of windings of the mainspring. This controls the torque output by the mainspring to a fixed range. The addition and subtraction wheel train allows efficient use of space, and can be incorporated in a watch.

67 Claims, 17 Drawing Sheets

MAINSPRING DEVICE, TIMEPIECE, AND METHOD OF CONTROLLING THE MAINSPRING DEVICE AND THE TIMEPIECE

BACKGROUND OF THE INVENTION

1. Field of the Invention

The present invention relates to a mainspring device, a timepiece, and a method of controlling the mainspring device and the timepiece. The present invention can be applied to a mechanical timepiece including a mainspring, which is wound up either by hand or automatically, and a timed annular balance, and to an electronic control type mechanical timepiece in which hands, affixed to a wheel train, are moved precisely by converting mechanical energy, output when the mainspring is unwound, into electrical energy by a generator in order to actuate a rotation controller using the electrical energy and control the rotation period of the generator.

2. Description of the Related Art

A mechanical timepiece whose hands are moved by utilizing mechanical energy of a mainspring is conventionally known.

Many electronic control type mechanical timepieces, such as that disclosed in Japanese Unexamined Patent Publication No. 8-5758, have been used in recent years. The timepiece, disclosed in the aforementioned document, indicates the exact time by precisely moving the hands affixed to a wheel train. The hands are moved by converting mechanical energy, output when the mainspring is unwound, into electrical energy by a generator in order to actuate a rotation controller using the electrical energy and to control the value of the current flowing in the coil of the generator.

As shown in FIG. 22, at the stage of winding up a mainspring when the number of windings reaches a predetermined number A, the torque that has been accumulating in the mainspring suddenly becomes large so that a very large torque is output when unwinding of the mainspring is started. The large torque is exerted onto a controlling portion of a speed regulator or an escapement, for example, which controls the rotational speed of a wheel train which rotates the mainspring. This sudden, large torque may cause component parts of the timepiece to break.

On the other hand, at the last stage of unwinding a mainspring when the number of windings is equal to or less than a predetermined number B, the torque output from the mainspring becomes very small, causing the hands to gradually slow down. This may cause the timepiece to indicate the wrong time. In an electronic control type mechanical timepiece, for example, when the mainspring is unwound to a certain degree, the amount of electrical power generated by the generator becomes so small that the generator rotates at a speed which is less than a speed that can be controlled. Therefore, the hands do not move precisely, causing the timepiece to indicate the wrong time.

To prevent this circumstance, clocks are provided with a winding-up and unwinding stop mechanism that prevents winding or unwinding of the mainspring beyond a certain maximum number of windings (during winding) or minimum number of windings (during unwinding). In general, the winding-up and unwinding stop mechanism uses a maltese-cross type mechanism, such as that shown in FIG. 23. It includes a finger 102, affixed to a barrel arbor 101, and a gear 103, called a maltese-cross, mounted to a barrel drum.

As shown in FIG. 23(A), a finger head 102*a* of the finger 102 engages a cut in the gear 103, which can rotate freely, initially, and move along the circumference of the finger 102 by progressively sliding therealong.

When the timepiece is wound, the barrel arbor 101 rotates, causing the finger 102 to rotate, so that one tooth of the gear 103 advances upon one rotation. Eventually, as shown in FIG. 23(A), a flat tooth 103*a* of the gear 103 engages the finger head 102*a*, thereby stopping the rotation of the barrel arbor 101 and locking the winding-up operation to prevent further winding of the mainspring.

During operation of the timepiece (that is, when the mainspring is being unwound), the finger 102 is fixed, and the gear 103 rotates along with the barrel drum, with the barrel arbor 101 at the center, such that one tooth advances upon one rotation, as shown in FIG. 23(B). After the barrel drum rotates four times, the flat tooth 103*a* and the finger head 102*a* engage each other, as shown in FIG. 23(C), thereby locking the unwinding operation to prevent any further unwinding of the mainspring.

The maltese-cross type winding-up and unwinding stop mechanism has a simple structure and requires few parts. However, since the winding operation is stopped by bringing a flat tooth of a gear into contact with a finger head, both components must be strong, which is realized by making them relatively large.

In addition, the finger and the gear must be placed upon a barrel drum. This causes the barrel drum to become thicker, so that the above-described maltese-cross winding-up and unwinding stop mechanism can only be used in a clock which has a large space for accommodating component parts in its interior, and cannot be used in watches which only have a small space available for components.

Therefore, in watches, it is difficult to limit the winding up and unwinding of the mainspring. As a result, breakage of parts still occurs when a very large torque is exerted onto the parts, and the wrong time is indicated when the torque becomes very small. Consequently, there is a demand for a way to output a torque whose value lies within a set range during winding and unwinding.

Accordingly, it is an object of the present invention to provide a mainspring device, a timepiece, and a method of controlling the mainspring device and the timepiece, wherein even when the mainspring device is used in a watch having a small space for accommodating component parts in its interior, neither an excessive torque nor an inadequate torque is output, that is, a torque that is within a set range is output at all times.

Electronic control type mechanical timepieces can control with high precision the rotation period of a generator, that is, the rotational period of the hands. This precision control results from driving a rotation control circuit, which includes a crystal oscillator, using electrical energy that has been generated in the timepiece. Such timepieces can indicate time more accurately than a conventional mechanical timepiece.

However, since it is necessary to stop the hands during hand adjustments, the wheel train, as well as the generator, must be stopped. Therefore, when the generator is stopped so that generation of electrical power is stopped, driving of the rotation control circuit can be continued only for a certain period of time using the electrical power stored in a charged capacitor. However, when the capacitor has completely discharged, the rotation control circuit stops.

After the rotation control circuit has stopped, when hand adjustments are completed and driving of the generator is started, hand movements cannot be controlled until driving of the control circuit is started. Therefore, there has been an attempt to preset the time during which hand movements cannot be controlled in order to correct the starting time of the control operation. Here, when the magnitude of the torque output from the mainspring changes, the amount of time until which the generator drives the control circuit also changes, so that the amount of correction is set in accordance with the magnitude of a predetermined output torque.

However, at the last stage of mainspring winding-up operations the torque accumulated in the mainspring suddenly becomes large, and a slight change in the winding amount greatly changes the magnitude of the torque, causing the torque to change greatly with every winding operation. Therefore, the corrections, even when they are made, are not sufficient.

It is another object of the present invention to provide a mainspring device, a timepiece, and a method of controlling the mainspring device and the timepiece, wherein when, for example, an electronic control type mechanical timepiece is used, corrections can be made very precisely even when the rotation control circuit has been stopped.

SUMMARY OF THE INVENTION

According to the present invention, there is provided a mainspring device constructed so as to drive a wheel train by mechanical energy of a mainspring, comprising: a winding-up portion for accumulating energy in the mainspring; an addition and subtraction wheel train for adding and subtracting the amount by which the mainspring is wound up and unwound; an addition and subtraction wheel, disposed in the addition and subtraction wheel train, for adding and subtracting the amount by which the mainspring is wound up and unwound; and a lock mechanism, which is actuated in response to the rotation of the addition and subtraction wheel, for preventing transmission of torque with a value that lies outside a set range from the mainspring to the wheel train.

According to the present invention, the amount by which the mainspring is wound up and unwound is detected by using an addition and subtraction wheel train, and the lock mechanism is actuated in response to the rotation of the addition and subtraction wheel to which a torque produced during the winding or unwinding operation is exerted. Therefore, the winding operation can be locked before the torque on the mainspring becomes very large, or the wheel train can be stopped before rotation of the wheel train becomes imprecise as a result of a reduction in the output torque. Therefore, a torque whose value lies within a set range can be output at all times.

The addition and subtraction wheel train is constructed using a plurality of gears or the like, making it unnecessary to construct it like the maltese-cross type winding stop mechanism, which is constructed using only two members that are directly mounted to the barrel arbor and the movement barrel. Therefore, the addition and subtraction wheel, or the like, can be disposed in the space around the movement barrel through the wheel train. Consequently, even when the mainspring device is used in a watch having only a small space for accommodating component parts, the addition and subtraction wheel train can be disposed in ample space, making it possible to stop the winding up of the mainspring.

For example, the lock mechanism may comprise a winding-up lock mechanism portion which, when the mainspring is wound up to a predetermined value, locks a winding-up wheel train in order to stop the winding up of the mainspring. Torque produced during winding-up operations is transmitted to the winding-up wheel train disposed in the addition and subtraction wheel train, and/or the winding-up portion.

In this form, when the mainspring is wound up to a number of windings that is equal to or greater than a predetermined value, the winding-up wheel train and the winding-up portion are locked (stopped) by the winding-up lock mechanism portion in response to the rotation of the addition and subtraction wheel. Thus, the winding-up operation can be more reliably stopped, thus making it possible to prevent, in particular, overwinding of the mainspring.

Here, the winding-up lock mechanism portion is not required to perform locking operations by disengaging a gear. For example, the winding-up lock mechanism portion may stop the winding up of the mainspring by locking a torque transmitting component part which has a torque equal to or less than a gear directly connected to a torque input side of the mainspring and which is disposed in the winding-up wheel train and/or the winding-up portion.

Locking a torque transmitting part (for example, a gear) with a smaller torque allows the winding-up operation to be stopped with a smaller force. Therefore, the strength of the component parts of the winding-up lock mechanism portion can be made small, which allows the parts to be made smaller and thinner.

For example, the winding-up lock mechanism portion may perform a locking operation by stopping torque transmission to the winding-up wheel train or to the winding-up portion.

Further, the lock mechanism may be, for example, an unwinding lock mechanism portion which, when the mainspring is unwound to a number of windings equal to or less than a predetermined value, stops the rotation of the wheel train by locking a unwinding wheel train. Torque produced during unwinding operations is transmitted to the unwinding wheel train disposed in the addition and subtraction wheel train, and/or the wheel train.

In this form, the unwinding lock mechanism portion, which operates in response to the rotation of the addition and subtraction wheel, locks the wheel train when the mainspring is unwound to a number of windings equal to or less than the predetermined value, so that the wheel train can be forced to stop before it becomes incapable of rotating precisely as a result of reduced output torque in the mainspring.

The unwinding lock mechanism portion may, for example, stop hand movement by disengagement of a gear in the wheel train. A gear can be disengaged by a lever, for example, which is actuated in response to the number of windings of the mainspring reaching a predetermined value. This prevents the torque on the mainspring from being transmitted, thereby allowing the wheel train to be reliably stopped.

The unwinding lock mechanism portion is not required to perform a locking operation by disengaging gears. It may, for example, stop the rotation of the wheel train by locking a torque transmitting component part which has a torque equal to or less than a gear directly connected to a torque output side of the mainspring and which is disposed in the unwinding wheel train and/or the wheel train.

By locking a gear with a small torque, the unwinding operation can be stopped with less force than that required to stop hand movements in the case where the torque on the movement barrel is directly received to stop the unwinding operation. Therefore, the required strength of the component parts of the unwinding lock mechanism is reduced, which allows these component parts to be made small and thinner.

It is also desirable that the winding-up lock mechanism portion lock a gear in the winding-up wheel train with any gear in a torque transmission path formed on the mainspring side, with reference to the gear being driven by rotation of an oscillating weight in order to cause the torque from the oscillating weight to wind up the mainspring and to drive the winding-up wheel train. The winding-up lock mechanism portion comprises a slip mechanism section, which is provided in the torque transmission path, for preventing transmission of torque, during actuation of the winding-up lock mechanism, from the oscillating weight to the mainspring and the addition and subtraction wheel.

In this case, when a gear is locked by the winding-up lock mechanism portion, a slip mechanism portion is actuated to cause the oscillating weight to rotate idly, so that when the oscillating weight is locked the oscillating weight itself is not broken, and rotation is not transmitted from the oscillating weight towards the addition and subtraction wheel, thereby preventing breakage of the winding-up lock mechanism portion in a locked state due to undue force exerted thereon, and ensuring that the hand of the addition and subtraction wheel indicates the exact time. Therefore, the winding-up lock mechanism portion can be applied to an automatic winding type mainspring device.

It is preferable that the winding-up lock mechanism portion comprise a winding-up lock lever which is lockable by engagement with at least one of the component parts to which torque is transmitted during a winding up operation; and that the unwinding lock mechanism comprise an unwinding lock lever which is lockable by engagement with at least one of the component parts to which torque is transmitted during an unwinding operation. These lock levers ensure proper locking operations.

It is preferable that the winding-up lock lever has a stopper portion which is engageable with at least one gear in the winding-up wheel train and/or the winding-up portion; and that the unwinding lock lever has a stopper portion which is engageable with at least one gear in the unwinding wheel train and/or the wheel train.

Although the winding-up wheel train, the winding-up portion, the unwinding wheel train, and the wheel train can be locked by braking the wheel trains that are torque transmitting component parts, by, for example, frictional force, the winding-up wheel train and the winding-up portion can be reliably and easily locked by engaging the lever stopper portion with the teeth of a gear.

One wheel or a plurality of wheels may be brought into engagement with the stopper portion in order to perform a locking operation.

When the lock mechanism comprises the aforementioned winding-up lock mechanism portion and the unwinding lock mechanism portion, they may be integrally formed into one multilock lever in order to reduce the number of component parts and to allow more efficient use of space.

It is preferable that the rotational center of the winding-up lock lever, the unwinding lock lever, and the multilock lever be disposed between corresponding component parts with which the lock levers engage, and the corresponding addition and subtraction wheels. In this case, the distance from the rotational centers to the corresponding component parts and the distance from the rotational centers to the corresponding addition and subtraction wheels can be made shorter, so that each of the lock levers can be made more rigid.

It is desirable that the addition and subtraction wheel have an operation engaging portion, being a groove or a protrusion, at the outer periphery thereof; and the lock lever press-contact the addition and subtraction wheel, and have an engaging protrusion which is engageable with the operation engaging portion of the addition and subtraction wheel; and that when the engaging protrusion is brought into engagement with the operation engaging portion of the addition and subtraction wheel, the lock lever engages and stops the component part associated therewith.

When the engaging protrusion of the lock lever is made to press-contact the addition and subtraction wheel, the engaging protrusion can reliably be brought into engagement with the operation engaging portion, such as a groove, or can be kept in contact with the outer periphery of the addition and subtraction wheel, allowing the lock lever to be stable and actuated without any vibration, and thus making the winding-up lock mechanism portion and the unwinding lock mechanism portion more reliable.

It is preferable that the lock lever press and clamp the sides of the addition and subtraction wheel about its circumference. This helps to secure the rotational shaft of the addition and subtraction wheel in position.

Preferably, the portion of the lock lever that engages the associated component part may be made resilient. In this case, even when a force is further exerted onto the engaging portion of the lock lever in engagement with its associated component part, this exerted force is absorbed by the resilient engaging portion, so that undue force does not act on the component part, thereby preventing breakage thereof.

In another embodiment, the portion of the lock lever which engages the associated component part may be made rigid; and the addition and subtraction wheel, which actuates the lock lever, may be mounted on the same rotational shaft of a gear that transmits torque to the addition and subtraction wheel. Backlash is provided between the gear and the addition and subtraction wheel, the addition and subtraction wheel rotating ahead of the gear by an amount corresponding to the amount of backlash when the lock lever is being actuated.

In this case, the lock lever, which is rigid, can reliably perform a locking operation with a large amount of dragging force. Since, at the moment the lock lever engages its associated component part, the addition and subtraction wheel (or operation engaging portion) rotates ahead, the lock lever can be instantaneously brought into engagement with its associated component part, so that even when the lock lever is made rigid, less wear, or the like, occurs in the associated component part.

In the present invention, when the winding-up lock lever and the unwinding lock lever are separately formed, the term "the lock lever" may refer to one of these lock levers or both of these lock levers, whereas when the winding-up lock lever and the unwinding lock lever are integrally formed to form one multilock lever, the term "the lock lever" refers to the multilock lever.

It is preferable that the timepiece of the present invention comprise a remaining life indicator that is driven by the addition and subtraction wheel. In this case, the remaining life indicator allows the life of the timepiece to be easily read. Preferably, the remaining life indicator is provided at the outer side of a wheel train bridge, which supports the wheel train. Since the remaining life indicator is provided at the back side of the timepiece, the design at the front side can be kept simple, while providing a remaining life confirmation function.

It is preferable that the mainspring device be an electronic control type which comprises a generator for converting mechanical energy of the mainspring transmitted through the wheel train into electrical energy, and a rotation controller, which is driven by the electrical energy, for controlling the rotation period of the generator.

The mainspring device of the present invention may form part of a timepiece.

In the present invention, there is provided a timepiece which comprises a mainspring for accumulating therein energy by actuating a winding-up portion, a generator for converting mechanical energy of the mainspring transmitted through a wheel train into electrical energy, a hand connected to the wheel train, and a rotation controller, which is driven by the electrical energy, for controlling the rotation period of the generator. The timepiece further comprises either one of a winding-up lock mechanism which, when the mainspring is wound up to a number of windings that is equal to or greater than a predetermined number of windings, stops the winding up of the mainspring by locking the winding-up portion; and an unwinding lock mechanism which, when the mainspring is unwound to a number of windings that is equal to or less than a predetermined number of windings, stops hand movement by locking the wheel train that transmits torque from the mainspring towards the generator.

In such an electronic control type mechanical timepiece, when a winding-up lock mechanism is provided, the winding up of the mainspring can be locked when it is wound up to a predetermined number of windings, so that at the start of unwinding of the mainspring the output torque will not be very large, whereby the output torque can be kept at a virtually constant value. Upon startup of the rotor immediately after hand adjustments, it is possible to precisely predict when control operations can be performed after driving of the control circuit is started. Even when the rotation control circuit is not operating during hand adjustments performed after locking the winding-up operation, corrections can be made very precisely during the time the control circuit is not operating. Therefore, the electronic control type mechanical timepiece can indicate time even more precisely.

In such an electronic control type mechanical timepiece provided with a winding-up lock mechanism, even when, as described above, the output torque on the mainspring is reduced to a low value so that precise hand movements cannot be achieved, the wheel train and the hand can be forced to stop, thus allowing torque within a set range to be output at all times.

Preferably, the timepiece may further comprise a timepiece hand adjusting mechanism, and a hand-adjusting lock mechanism which, when the mainspring is unwound to the number of windings that is equal to or less than the predetermined number of windings, locks the timepiece hand adjusting mechanism so that it is not actuated.

When a hand adjusting lock mechanism is provided, hand adjustments cannot be performed until the mainspring is sufficiently wound up. Hand adjustments can then be performed after a capacitor has been charged. Therefore, when the timepiece is reset after hand adjustments, the system can be kept driven by the capacitor, thereby allowing hand movements to be controlled very precisely.

It is preferable that the electronic control type mechanical timepiece further comprise an addition and subtraction wheel train driven by the addition and subtraction of accumulated energy corresponding to the amount by which the mainspring is wound up and unwound, respectively. Also provided is an addition and subtraction wheel, disposed in the addition and subtraction wheel train, for transmitting thereto torque obtained by adding and subtracting the amount by which the mainspring is wound up and unwound, wherein the winding-up lock mechanism is actuated in response to the rotation of the addition and subtraction wheel when the mainspring is wound up to the number of windings that is equal to or greater than a first predetermined number of windings, and locks the winding-up wheel train, to which torque produced during a winding-up operation is transmitted in the addition and subtraction wheel train, and/or the winding-up portion, in order to stop the winding up of the mainspring.

By using an addition and subtraction wheel train, space can be efficiently used, and the winding up of the mainspring can be stopped even within the confines of a watch.

It is desirable that the electronic control type mechanical timepiece comprise the addition and subtraction wheel train driven by the addition and subtraction of accumulated energy corresponding to the amount by which the mainspring is wound up and unwound, respectively, and the addition and subtraction wheel, which is disposed in the addition and subtraction wheel train, for transmitting thereto torque obtained by adding and subtracting the amount by which the mainspring is wound up and unwound; wherein the unwinding lock mechanism portion which, when the mainspring is unwound to the number of windings that is equal to or less than a predetermined number of windings, is actuated in response to the rotation of the addition and subtraction wheel, and which locks the unwinding wheel train, to which torque produced during unwinding operations is transmitted in the addition and subtraction wheel train, and/or the wheel train connected to the unwinding wheel train, in order to stop hand movement.

By using an addition and subtraction wheel train, space can be efficiently used, and the unwinding of the mainspring can be stopped even in the confines of a watch.

The present invention also provides a method of controlling a winding-up operation of a mainspring device comprising a mainspring, a generator for converting mechanical energy of the mainspring transmitted through a wheel train into electrical energy, and a rotation controller, which is driven by the electrical energy produced by the generator, for controlling the rotation period of the generator, wherein when the mainspring is wound up to a number of windings that is equal to or greater than a predetermined number of windings, by a winding-up portion, used for accumulating energy in the mainspring, and the winding-up lock mechanism locks the winding-up portion in order to stop the winding up of the mainspring.

In the present invention, since the winding up of the mainspring can be locked when the mainspring is wound up to the predetermined number of windings, the output torque produced when unwinding of the mainspring is started is not very large, so that the output torque can be kept at a virtually constant value, whereby corrections can be made very precisely while the control circuit is not operating.

In the present invention, there is provided a method of controlling a winding-up operation of a mainspring device comprising a mainspring, a generator for converting mechanical energy of the mainspring transmitted through a wheel train to electrical energy, and a rotation controller, which is driven by the electrical energy produced by the generator, for controlling the rotation period of the generator, wherein when the mainspring is unwound to a number of windings that is equal to or less than a predetermined number of windings, and the unwinding lock mechanism locks the wheel train in order to stop the rotation of the wheel train.

In the present invention, the unwinding of the mainspring can be locked when it is unwound to a predetermined number of windings, so that when the output torque of the mainspring is reduced to a low value and precise hand movements cannot be achieved, the wheel train, that is the hand, can be forced to stop, whereby a torque whose value lies within a set range can be output at all times.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Figure 1:
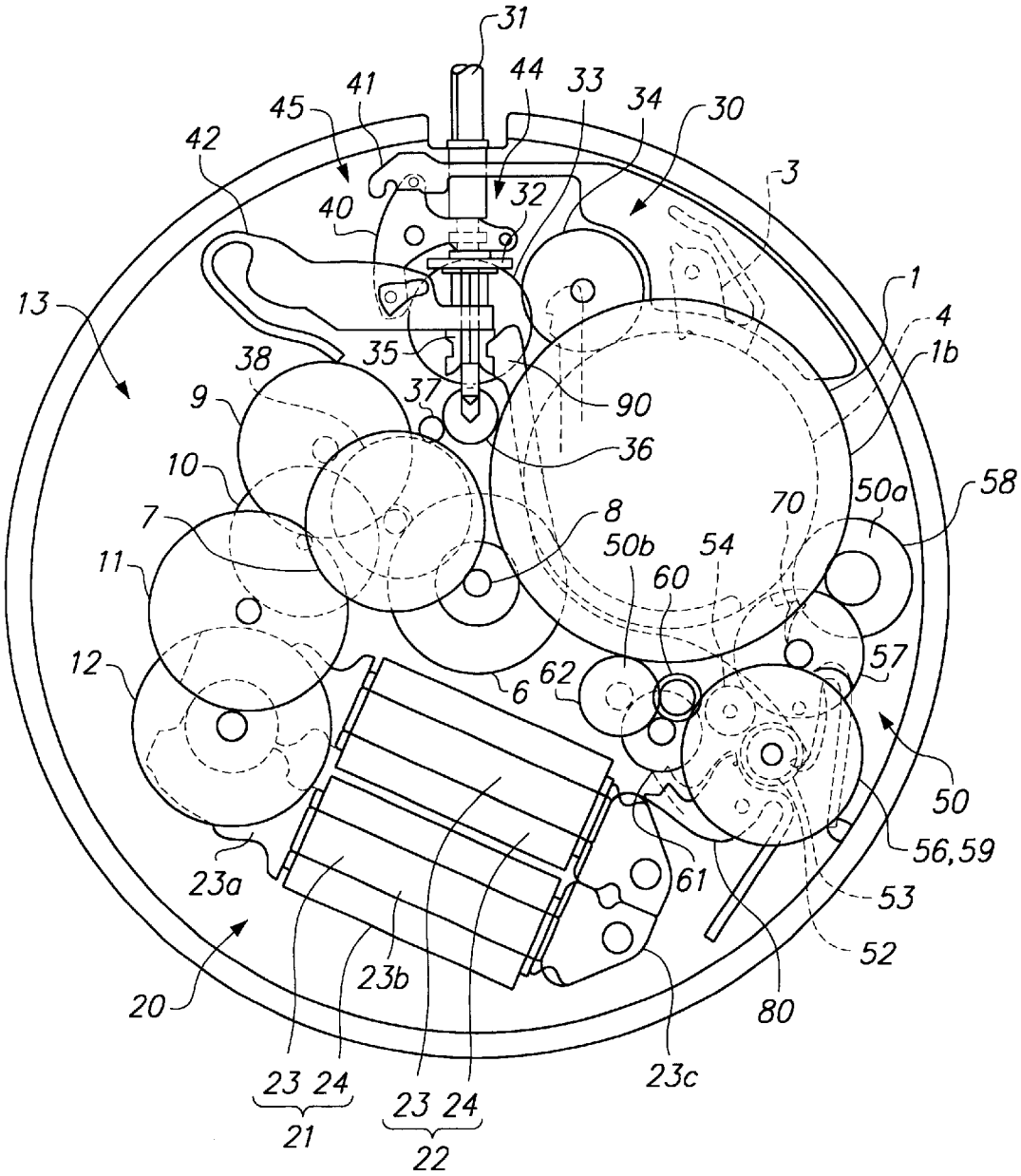
FIG. 1 is a plan view of a first embodiment of the electronic control type mechanical timepiece in accordance with the present invention.
Figure 2:
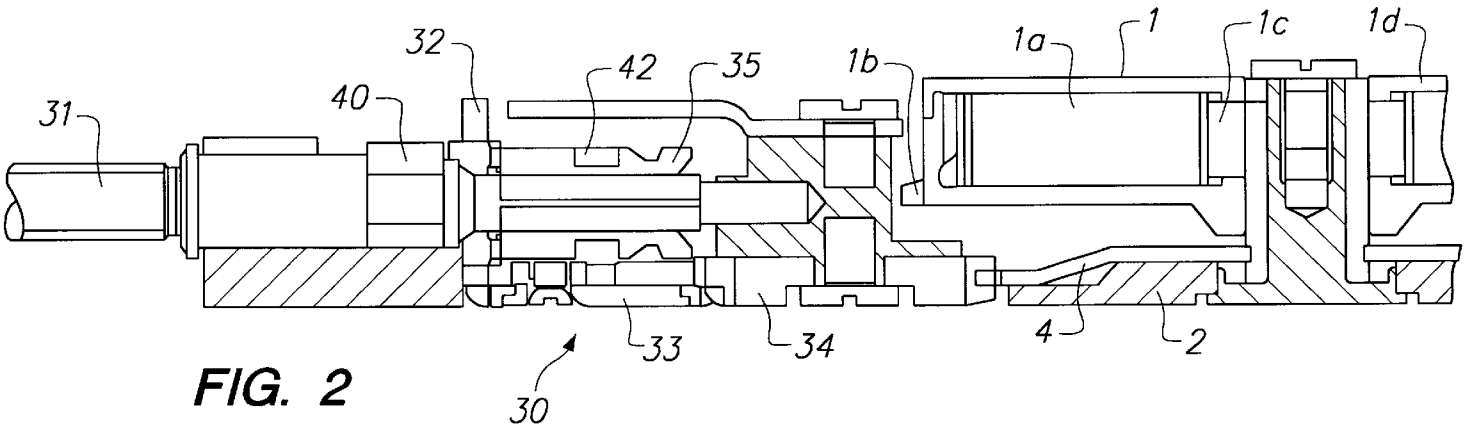
FIG. 2 is a sectional view of the main portion of the electronic control type mechanical timepiece of FIG. 1.
Figure 3:
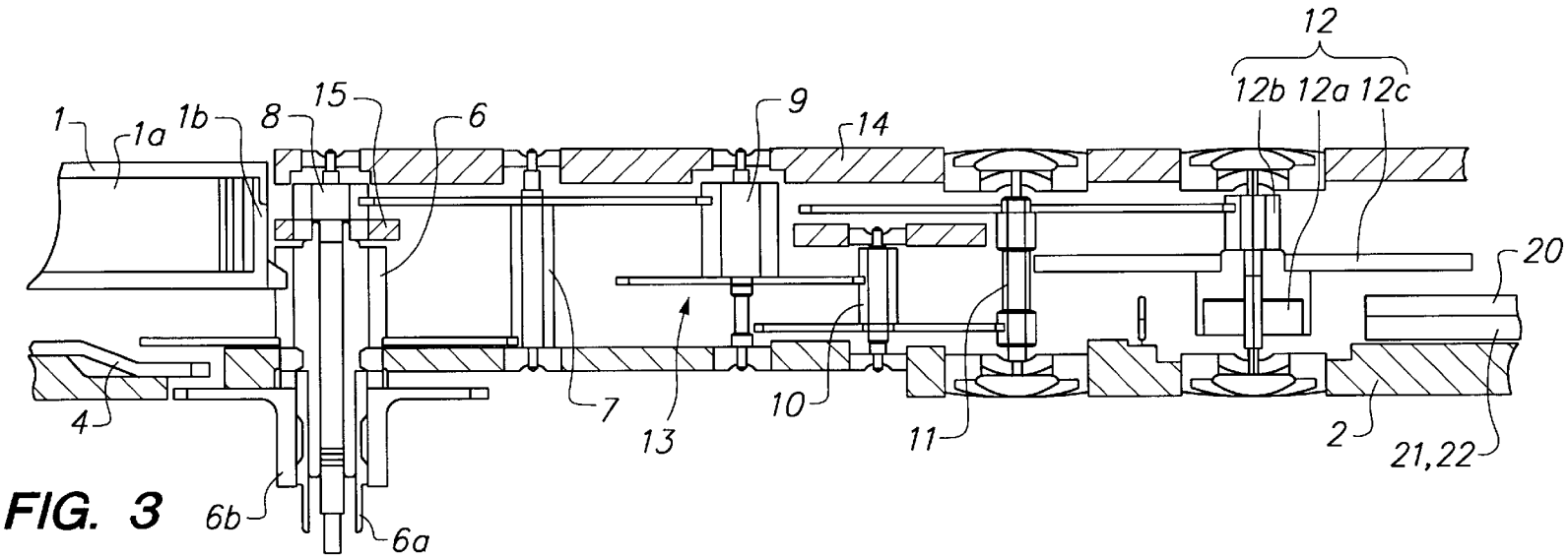
FIG. 3 is another sectional view of the main portion of the electronic control type mechanical timepiece of FIG. 1.
Figure 4:
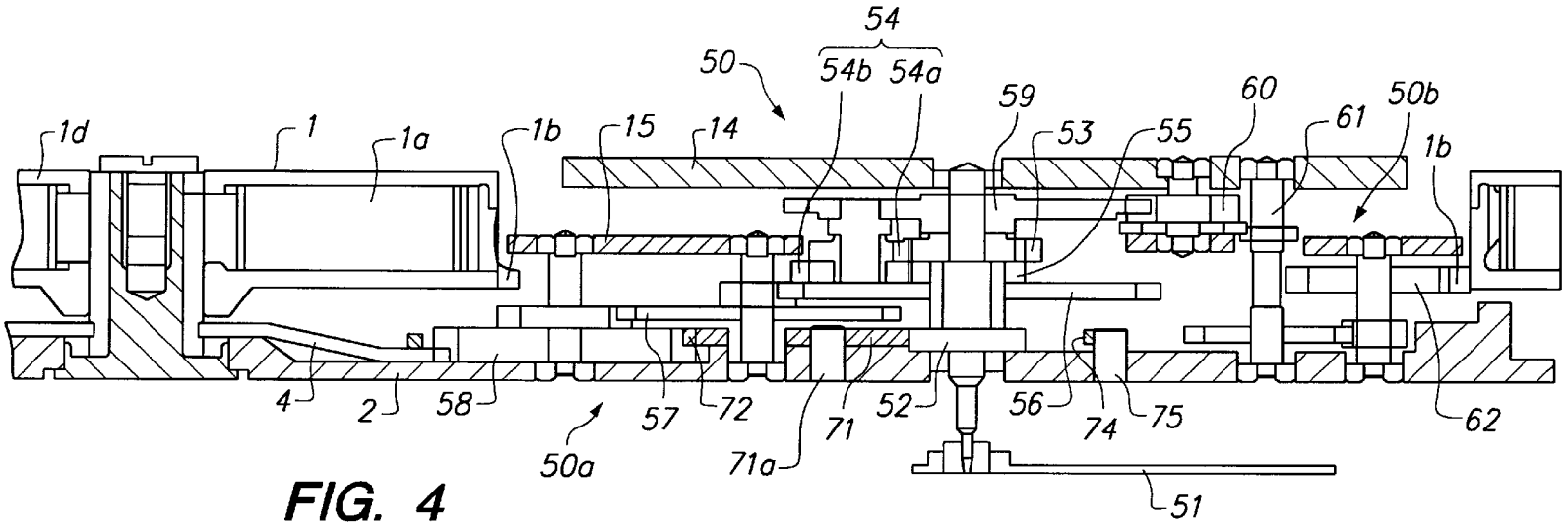
FIG. 4 is yet another sectional view of the main portion of the electronic control type mechanical timepiece of FIG. 1.

FIG. 1 is a schematic plan view of an embodiment of the electronic control type mechanical timepiece used as a mainspring device in accordance with the present invention; and FIGS. 2 to 4 are sectional views of the main portion of the electronic control type mechanical timepiece.

In FIGS. 1 to 4, the electronic control type mechanical timepiece comprises a movement barrel 1 composed of a mainspring la, a barrel wheel gear 1*b*, a barrel arbor 1*c*, and a barrel cover 1*d*. The mainspring 1*a* has its outer end affixed to the barrel wheel gear 1*b* and its inner end affixed to the barrel arbor 1*c*. The barrel arbor 1*c* is supported by a main plate 2 and is capable of rotating integrally with a ratchet wheel 4.

The ratchet wheel 4 meshes with a click 3 so that it rotates clockwise and does not rotate counterclockwise. The ratchet wheel 4 is constructed such that when a winding stem 31, connected to a crown which is not shown, is operated, it rotates through a winding pinion 32, a crown wheel 33, and an intermediate ratchet wheel 34, and causes the barrel arbor 1*c* to rotate in order to wind up the mainspring 1*a*. Accordingly, a winding-up portion 30, in which energy accumulates, is formed by the winding stem 31, the winding pinion 32, the crown wheel 33, the intermediate ratchet wheel 34, and the ratchet wheel 4.

As shown in FIG. 3, the rotation of the barrel wheel gear 1*b* is transmitted to a second wheel 6, and successively transmitted to a third wheel 7, a second hand wheel 8, a fourth wheel 9, a fifth wheel 10, a sixth wheel 11, and then to a rotor 12. A minute hand, which is not shown, is affixed to the second wheel 6 through a cannon pinion 6*a*, while a second hand is affixed to the second hand wheel 8. An hour wheel 6*b* is affixed to the cannon pinion 6*a* through a minute wheel 38, with an hour hand being affixed to the hour wheel 6*b*.

The wheels 6 to 11 and the rotor 12 are supported by a wheel train bridge 14, a center wheel bridge 15, and the main plate 2. The wheels 6 to 11 form a primary wheel train 13 for transmitting the mechanical energy of the mainspring 1*a* to the hour hand, the minute hand, and the second hand.

As shown in FIG. 1, the electronic control type mechanical timepiece comprises a generator 20 including the rotor 12 and coil blocks 21 and 22. As shown in FIG. 3, the rotor 12 comprises a rotor magnet 12*a*, a rotor pinion 12*b*, and a rotor inertia disk 12*c*. The rotor inertia disk 12*c* is provided to reduce the amount of variation in the rotational speed of the rotor 12 due to variations in the driving torque from the movement barrel 1.

With reference to FIG. 1, the coil blocks 21 and 22 are each formed by winding a coil 24 around its associated core 23. Each core 23 comprises a core stator portion 23*a*, disposed adjacent to the rotor 12; a core winding portion 23*b*, upon which is wound the associated coil 24; and a core magnetism conducting portion 23*c*. The core magnetism conducting portions 23*c* are linked together and integrally formed.

In the above-described electronic control type mechanical timepiece, alternating current output from the generator 20 is input to a rectifying circuit comprising a step-up and rectifying portion, a full-wave rectifying portion, a half-wave rectifying portion, a transistor rectifying portion, etc., causing the alternating current output to be stepped-up and rectified. The resulting alternating current charges an output smoothing capacitor. The electrical power from the capacitor causes a rotation control circuit, which is not shown, to control the rotation of the generator 20. It is to be noted that the rotation control circuit comprises an integrated circuit (IC), which includes, for example, an electromagnetic brake, an oscillation circuit portion, a frequency dividing portion, a rotation detecting circuit, and a rotational speed comparing circuit. For the oscillation circuit, a crystal oscillator is used.

Adjustments of the minute hand and the hour hand are performed by axially moving the winding stem 31 by pulling out the crown, and by moving a sliding portion 35 towards a setting wheel 36 and engaging it therewith by the action of a setting lever 40, a click spring 41, and a yoke 42. Then, the cannon pinion 6*a* and the hour wheel 6*b* are rotated through the setting wheel 36, an intermediate minute wheel 37, and the minute wheel 38. Accordingly, a hand adjusting mechanism 44 is formed by the crown, the winding stem 31, the sliding portion 35, the setting wheel 36, the intermediate minute wheel 37, the minute wheel 38, the setting wheel 40, the click spring 41, and the yoke 42.

As further shown in FIGS. 1 and 4, the electronic control type mechanical timepiece comprises a wheel train 50 for adding and subtracting the amount by which the mainspring 1*a* is wound up and unwound.

The wheel train 50 comprises an eightieth wheel 52 affixed to a power reserve needle 51 serving as remaining life indicator; a power reserve wheel 53 affixed to a shaft of the eightieth wheel 52; an eighty-first wheel 54 comprising a first planetary wheel portion 54*a*, which engages the power reserve wheel 53, and a second planetary wheel portion 54*b*, which is formed integrally with the first planetary wheel portion 54*a*; a planetary intermediate wheel 55 which engages the second planetary wheel portion 54*b* of the eighty-first wheel 54; an eighty-second wheel 56 which rotates integrally with the planetary intermediate wheel 55; an eighty-third wheel 57 which engages the eighty-second wheel 56; an eighty-fourth wheel 58 which engages the eight-third wheel 57; an eighty-fifth wheel 59 serving as a sun wheel mounted to the eighty-first wheel 54 being a planetary wheel; an eighty-sixth wheel 60 which engages the eighty-fifth wheel 59; an eight-seventh wheel 61 which engages the eighty-sixth wheel 60; and an eighty-eighth wheel 62 which engages the eighty-seventh wheel 61. The eighty-fourth wheel 58 engages the aforementioned ratchet wheel 4, while the eighty-eighth wheel 62 engages the movement barrel 1.

When the ratchet wheel 4 is rotated by winding up the mainspring 1*a*, the torque on the ratchet wheel 4 is progressively reduced as it is transmitted from the eighty-fourth wheel 58 to the eighty-third wheel 57, the eighty-second wheel 56, and the eighty-first wheel 54. Here, when the mainspring 1*a* is being wound up, since the barrel wheel gear 1*b* rotates very slowly so that it is virtually stationary, the wheels 59 to 62 are stationary. Therefore, the torque, transmitted to the eighty-first wheel 54, is such as to be transmitted from the power reserve wheel 53, the eightieth wheel 52, and the power reserve needle 51.

On the other hand, when unwinding of the mainspring 1*a* is being performed, the ratchet wheel 4 is not moving, so that the wheels 55 to 58 are stationary. When the barrel wheel gear 1*b* rotates, the torque on the barrel wheel gear 1*b* is progressively reduced as it is transmitted from the eighty-seventh wheel 61, the eighty-sixth wheel 60, and the eighty-fifth wheel 59. At this time, since the planetary intermediate wheel 55, which engages the eighty-first wheel 54, is stationary, the eighty-first wheel 54 revolves around the planetary intermediate wheel 55 as it rotates. This causes the power reserve wheel 53, which meshes with the eighty-first wheel 54, to rotate in a direction opposite to the direction in which it rotates when the mainspring 1*a* is being wound up, causing the eightieth wheel 52 and the power reserve needle 51 to also rotate in the opposite direction.

In this embodiment, the speed reduction ratio from the movement barrel 1 (or the ratchet wheel 4) to the eightieth wheel 52 is set at 1/12, so that when the number of windings of the mainspring 1*a* is set at six (the angle of rotation is 360°×6=2160°), the eightieth wheel 52, that is the power reserve needle 51, rotates 180 degrees.

The wheel train 50 comprises a winding-up wheel train 50*a*, formed by the eighty-fourth wheel 58, the eighty-third wheel 57, the eighty-second wheel 56, the planetary intermediate wheel 55, the eighty-first wheel 54, and the power reserve wheel 53, for transmitting torque from the ratchet wheel to the eightieth wheel 52. The wheel train 50 also comprises an unwinding wheel train 50*b*, formed by the eighty-eighth wheel 62, the eighty-seventh wheel 61, the eighty-sixth wheel 60, the eighty-fifth wheel 59, the eighty-first wheel 54, and the power reserve needle 53, for transmitting torque from the barrel wheel gear 1*b* to the eightieth wheel 52.

When the ratchet wheel 4 rotates, an amount of torque corresponding to the amount by which the mainspring 1*a* is wound up is transmitted to the eightieth wheel 52 and added as rotation of the eightieth wheel in a predetermined direction. Conversely, when the mainspring 1*a* is unwound and the barrel wheel gear 1*b* rotates, an amount of torque corresponding to the amount by which the mainspring 1*a* is unwound is transmitted to the eightieth wheel 52 and subtracted as rotation of the eightieth wheel 52 in the opposite direction. Accordingly, an addition and subtraction wheel is formed by the eightieth wheel 52.

Figure 5:
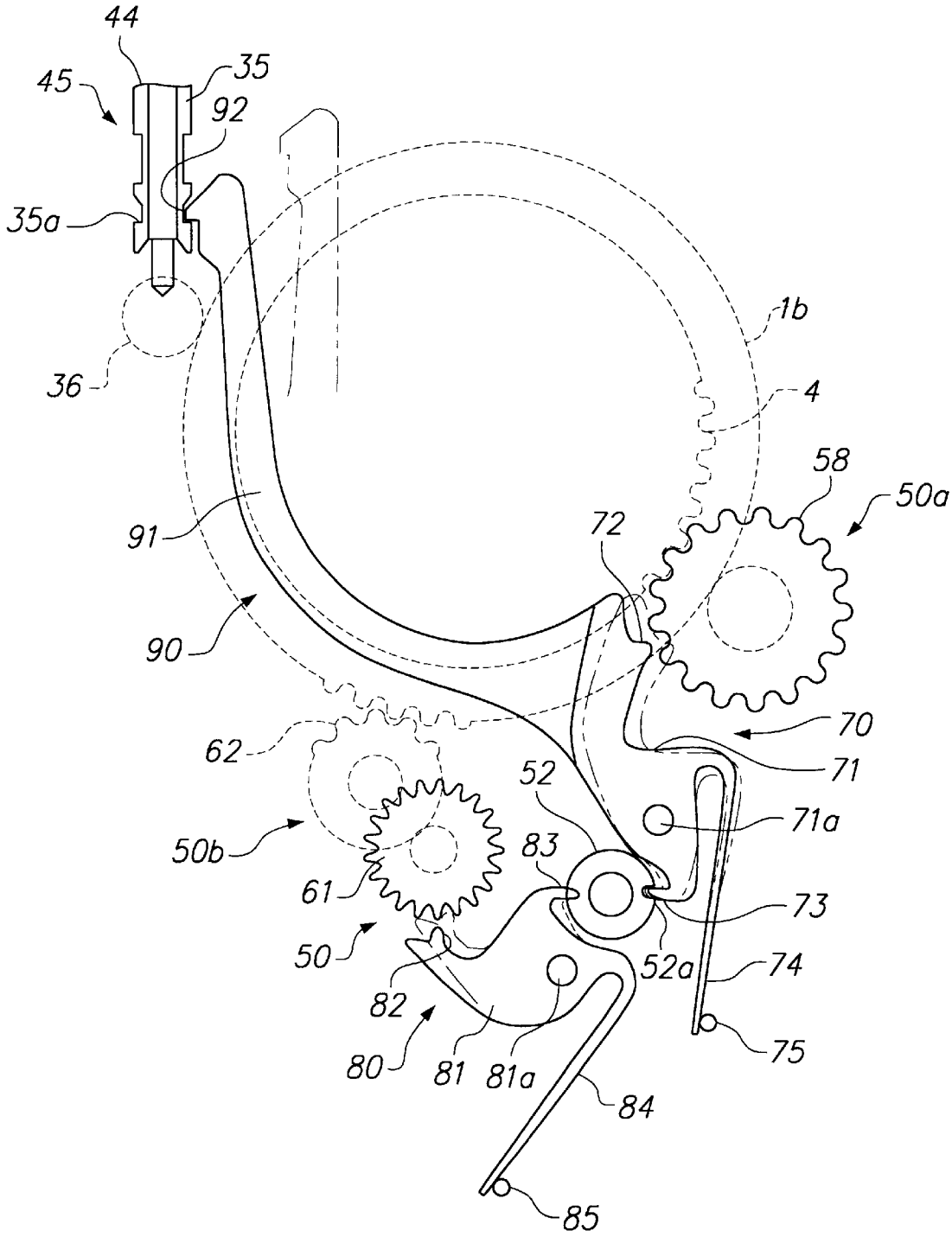
FIG. 5 is a schematic view of the main portion of each lock mechanism used in the first embodiment of the present invention.

As shown in FIG. 5, the eightieth wheel 52 is a disk-shaped wheel without any teeth along its outer periphery. It has a groove 52*a*, serving as an actuation engaging portion, in a portion of its outer periphery so as to extend in a diametrical direction.

Around the eightieth wheel 52 are provided a winding-up lock mechanism 70 for locking (or stopping) rotation of the winding-up wheel train 50*a*; a hand lock mechanism 80, serving as an unwind lock mechanism, for locking (or stopping) rotation of the unwind wheel train 50*b*; and a hand-adjusting lock mechanism 90 for locking the hand adjusting mechanism 44.

The winding-up lock mechanism 70 includes a winding-up lock lever 71 which engages the eighty-fourth wheel 58. The lever 71 can rotate about a rotation shaft 71*a*, disposed between the eighty-fourth wheel 58 and the eightieth wheel 52. The lever 71 comprises a stopper portion 72, which can engage the teeth of the eighty-fourth wheel 58, and an engaging protrusion 73, which can engage the groove 52*a* of the eightieth wheel 52. A spring portion 74, which extends from the body of the lever 71 so as to form a substantially U shape, presses against a stopper pin 75. The engaging protrusion 73 is pressed against the eightieth wheel 52 by the action of the spring portion 74. Therefore, when the engaging protrusion 73 engages the groove 52*a* of the eightieth wheel 52, the stopper portion 72 engages the eighty-fourth wheel 58, as indicated by the alternate long and two short dashed lines in FIG. 5. This locks, or stops, the rotation of the eighty-fourth wheel 58, and thereby the rotation of the winding-up wheel train 50*a*, the ratchet wheel 4, and the winding-up portion 30. As a result the winding up of the mainspring 1*a* is stopped.

Alternatively, when the engaging protrusion 73 is pressed against a location of the outer periphery of the eightieth wheel 52 other than the groove 52*a*, the stopper portion 72, as shown by the solid line in FIG. 5, is separated from the eighty-fourth wheel 58, allowing the mainspring 1*a* to be wound up.

As mentioned above, the eightieth wheel 52 is set so that it rotates 180 degrees when the mainspring 1*a* is wound six times, that is, when the ratchet wheel 4 rotates six times. Therefore, in the case where locking of the winding operation is to be performed when the desired number of windings has been reached (for example, when the number of windings has reached the value A, which is the number of windings before the output torque changes significantly for a mainspring 1*a* having the characteristics illustrated in FIG. 22), the eightieth wheel 52 is set at an angle which causes the engaging protrusion 73 to engage the groove 52*a* of the eightieth wheel 52.

Similarly, as shown in FIG. 5, the hand lock mechanism 80 includes a hand lock lever 81, serving as an unwinding lock lever, which engages the eighty-seventh wheel 61. The lever 81 rotates about a rotation shaft 81*a*, disposed between the eighty-seventh wheel 61 and the eightieth wheel 52. The hand lock mechanism 81 comprises a stopper portion 82, which can engage the teeth of the eighty-seventh wheel 61, and an engaging protrusion 83, which can engage the groove 52*a* of the eightieth wheel 52. A spring portion 84, which extends from the body of the lever 81 so as to form a substantially U shape, presses against a stopper pin 85. The stopper portion 82 and the engaging protrusion 83 press against the eighty-seventh wheel 61 and the eightieth wheel 52, respectively, by the action of the spring portion 84.

Accordingly, when the engaging protrusion 83 engages the groove 52*a* of the eightieth wheel 52, the stopper portion 82, as indicated by the alternate long and two short dashed lines of FIG. 5, engages the eighty-seventh wheel 61, thereby locking the rotation of the eighty-seventh wheel 61, and thus the rotation of the unwind wheel train 50*b*, so that the unwinding of the mainspring 1*a* and resultant hand movement is stopped.

Alternately, when the engaging protrusion 83 presses against a portion of the outer periphery of the eightieth wheel 52 other than the groove 52*a*, the stopper portion 82, as indicated by the solid line of FIG. 5, is separated from the eighty-seventh wheel 61, allowing rotation of the unwind wheel train 50*b*, and thus allowing hand movement.

Figure 22:
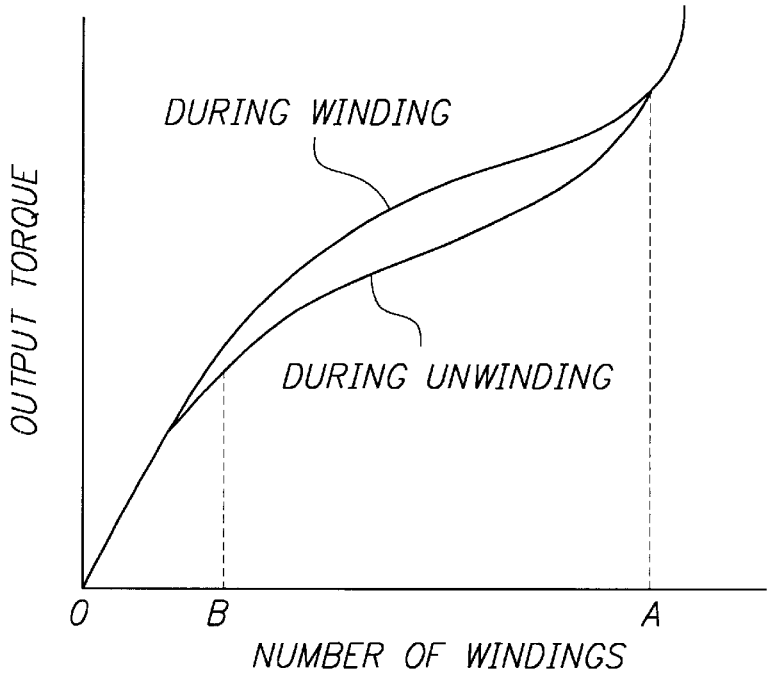
FIG. 22 is a graph showing mainspring characteristics.
Figure 23A:
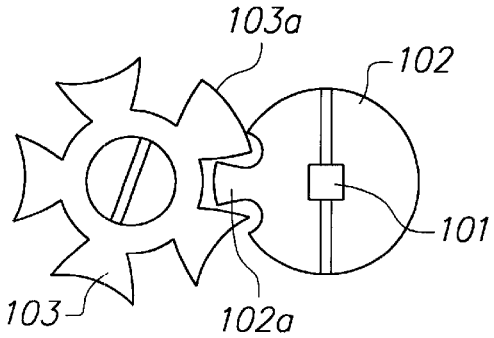
FIG. 23 is a schematic view of a conventional maltese-cross type winding-up and unwinding stop mechanism.
Figure 23B:
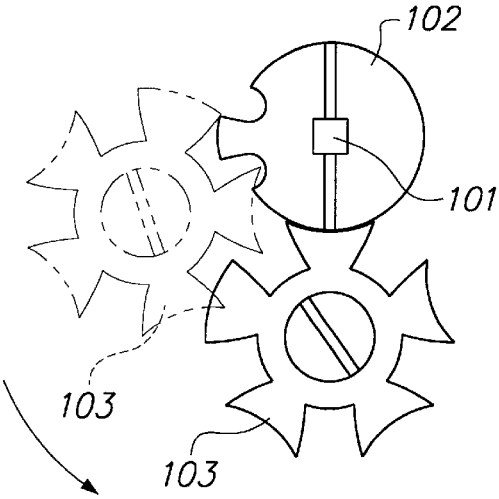
Figure 23C:
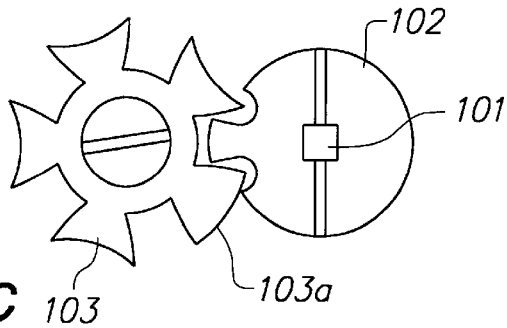

The hand lock lever 81 is set so that the engaging protrusion 83 engages the groove 52*a* of the eightieth wheel 52 to lock the unwinding operation (and stop the hand movement) when the desired number of unwinding operations has been performed. For example, in the case where a mainspring 1*a* having the characteristics illustrated in FIG. 22 is used, unwinding is locked at the moment the number of windings reaches the value B, which is the number of windings at which the output torque is greatly reduced.

In the present embodiment, locking of the winding operation is performed at the moment the winding operation is completed, that is, when the number of windings is six, whereas locking of the unwinding operation (or stopping of hand movement) is performed at the moment the output torque is reduced to a low value as a result of unwinding of the mainspring 1*a*, that is, when the number of windings of the mainspring 1*a* approaches zero. Therefore, the difference in the number of windings between the time the mainspring 1*a* is completely wound and the time the output torque is reduced to a low value as a result of unwinding the mainspring 1*a* is approximately six. The difference in the rotational angle of the eightieth wheel 52 between these two times is nearly 180 degrees. Therefore, the levers 71 and 81 are disposed such that their respective engaging protrusions 73 and 83 are positioned on opposite sides of the eightieth wheel 52 and separated by approximately 180 degrees. More specifically, they are separated by an angle of approximately 160 to 180 degrees.

As shown in FIG. 5, the hand-adjusting lock mechanism 90 includes a hand-adjusting lock lever 91 which engages the sliding pinion 35. The base end side of the lever 91 is formed integrally with the lever 71. A stopper portion 92, which can engage a groove 35*a* formed along the outer periphery of the sliding pinion 35, is formed at the other end of lever 91, which extends along the outer periphery of the ratchet wheel 4.

When the engaging protrusion 73 engages the groove 52*a* of the eightieth wheel 52, the stopper portion 92, as indicated by the alternate long and two short dashed lines, is separated from the sliding pinion 35, allowing the sliding pinion 35 to move towards the setting wheel 36, thus allowing the hand adjusting mechanism 44 to operate.

Alternately, when the engaging protrusion 73 presses against a location of the eightieth wheel 52 other than the groove 52*a*, the stopper portion 92 engages the sliding pinion 35 in order to lock the movement of the sliding pinion 35 toward the setting wheel 36. This locks the hand adjusting mechanism 44 so that hand adjusting operations, such as pulling out of the winding stem, cannot be carried out.

Therefore, until the winding-up operation is locked by the winding-up lock lever 71, that is, until the mainspring 1*a* is sufficiently wound up, the hand adjusting mechanism 44 is locked by the hand adjusting lock lever 91 so that hand adjusting operations cannot be carried out.

According to the present invention, the following effects are produced.

1) The winding-up lock mechanism 70 allows winding operations to be stopped before the torque on the mainspring 1*a* becomes considerably large, and the hand lock mechanism 80 allows a hand to be stopped before precise hand movement becomes impossible as a result of reduced output torque from the mainspring 1*a*, so that a torque within a set range can always be output from the mainspring 1*a*.

2) In particular, the winding-up lock mechanism 70 prevents overtightening of the mainspring 1*a*. Therefore, it is possible to prevent a very high torque, caused by overtightening of the mainspring 1*a*, from being exerted onto the wheel train 13, or the like, at the initial stage of the unwinding operation, and to prevent resultant breakage of the wheel train 13, or the like.

The winding-up lock mechanism 70, the hand lock mechanism 80, and the hand-adjusting lock mechanism 90 make use of the wheel train 50 disposed at the outer peripheral side of the movement barrel 1 and the ratchet wheel 4, making it possible to effectively use the space around the movement barrel 1, so that the timepiece can be made small and thin. In contrast, the aforementioned maltese-cross type winding-up and unwinding stop mechanism requires that gears be directly mounted to the barrel arbor 1*c* and the movement barrel 1, making the timepiece thicker by a proportionate amount, and more difficult to design as a result of less freedom with which component parts can be accommodated. According to the present embodiment, however, the timepiece can be designed with greater freedom, and space can be used effectively. As a result, even for a watch with a small space for accommodating component parts in its interior, a mechanism for stopping winding-up operations and unwinding operations (mechanism for stopping hand movement) and a hand-adjusting lock mechanism can be realized.

4) Rotation of the eighty-fourth wheel 58 is accelerated with respect to the ratchet wheel 4, and it has a smaller torque than the ratchet wheel. Ratchet wheel 4's rotation is controlled as a result of engagement of the winding-up lock lever 71 with the eighty-fourth wheel 58, so that the winding-up operation can be locked with a smaller force than that required to lock ratchet wheel 4 directly. Therefore, it is possible to reduce the required strength of the winding-up lock lever 71 and the eighty-fourth wheel 58, thereby allowing the component parts to be made smaller and thinner.

Similarly, rotation of the eighty-seventh wheel 61 is accelerated with respect to the movement barrel 1, and it has a smaller torque. Rotation of movement barrel 1 is controlled as a result of engagement of the hand lock lever 81 with the eighty-seventh wheel 61, so that the unwinding operation can be locked with a smaller force that that required to lock movement barrel 1 directly. Therefore, it is possible to reduce the required strength of the hand lock lever 81 and the eighty-seventh wheel 61, thereby allowing the component parts to be made smaller and thinner.

In order to lock the eighty-fourth wheel 58 and the eighty-seventh wheel 61, the wheels 58 and 61 may be braked as a result of, for example, frictional force. Since the stopper portion 72 of the lock lever 71 and the stopper portion 82 of the lock lever 81 engage the wheels 58 and 61, respectively, the winding-up wheel train 50*a* and the unwind wheel train 50*b* can be reliably and easily locked.

5) Since the engaging protrusion 73 of the winding-up lock lever 71 and the hand adjusting lock lever 91 and the engaging protrusion 83 of the hand lock lever 81 press against the eightieth wheel 52 by the action of the spring portion 74 and 84, respectively, the engaging protrusions 73 and 83 can be made to reliably engage the groove 52*a* and, alternatively, press against locations of the eightieth wheel 52 other than the groove 52*a*, so that they can operate with stability and without any vibration, making it possible to increase the reliability of the winding-up lock mechanism 70, the hand lock mechanism 80, and the hand-adjusting lock mechanism 90.

6) The rotation shaft 71*a* of the winding-up lock lever 71 is disposed between the eighty-fourth wheel 58 and the eightieth wheel 52, so that the distance from the rotation shaft 71*a* to the stopper portion 72, which engages the wheel 58, and the distance from the rotation shaft 71*a* to the engaging protrusion 73, which engages the wheel 52, can be made short, thereby allowing the winding-up lock lever 71 to be more rigid to a degree.

Similarly, the rotation shaft 81*a* of the hand lock lever 81 is disposed between the eighty-seventh wheel 61 and the eightieth wheel 52, so that the distance from the rotation shaft 81*a* to the stopper portion 82, which engages the wheel 61, and the distance from the rotation shaft 81*a* to the engaging protrusion 83, which engages the wheel 52, can be made short, thereby allowing the hand lock lever 81 to be more rigid to a degree.

The rotation shaft 71*a* of the hand-adjusting lock lever 91 is disposed between the sliding pinion 35 and the eightieth wheel 52, so that the distance from the rotation shaft 71*a* to the stopper portion 92, which engages the sliding pinion 35, and the distance from the rotation shaft 71*a* to the engaging protrusion 73, which engages the wheel 52, can be made short, thereby allowing the hand-adjusting lock lever 91 to be more rigid to a degree.

It is to be noted that when the rotation shafts 71*a* and 81*a* are disposed between associated wheels 52, 58, and 52, 61, respectively, the distance from the center of rotation of each of the associated wheels to the respective rotation shafts 71*a* and 81*a* is smaller than the distance between the centers of rotation of each pair 52, 58 and 52,61 of associated wheels.

7) Since the winding-up operation of the mainspring 1*a* can be locked when the mainspring 1*a* is wound a predetermined number of times, the output torque at the start of unwinding of the mainspring 1*a* is not very large, so that it can be maintained at a virtually constant value. Therefore, when the rotor 12 starts immediately after hand adjustments, it is possible to precisely predict when controlling operations can be performed after starting driving of the control circuit. Consequently, even when the rotation control circuit is not operating when hand adjustments have been performed after locking of the winding-up operation, precise corrections can be made during the time the control circuit is not operating, making it possible for the electronic control type mechanical timepiece to indicate time even more precisely.

8) Since a considerably high output torque is not produced, the speed regulating braking range, that is, the torque to be controlled, can be limited. Thus, the precision during speed regulation can be increased, making it possible to increase the precision with which time is indicated. In addition, since unnecessary braking controlling operations are not performed when an extremely high output torque is exerted, the timepiece life can be made longer due to less force exerted on the mainspring 1*a*.

9) Since a wheel train 50 is provided for adding and subtracting input winding-up torque and input unwinding torque in order to produce an output, and a power reserve needle 51 is provided at the eightieth wheel 52, the power reserve, i.e., the remaining life of the timepiece, can be indicated.

10) In the electronic control type mechanical timepiece, when the output torque on the mainspring 1*a* has been reduced to the degree that the amount of electrical power required to drive the control circuit is insufficient to control hand movement (called a free-run state), the hand lock mechanism 80 forces the wheel train 13, and thus the hands, to stop, thereby preventing indication of the wrong time.

When the output torque is reduced to a low value, and the hand lock mechanism 80 operates, the barrel wheel gear 1*b* also stops, causing the hour hand, the minute hand, and the second hand to stop. Therefore, when the output torque is low and the timepiece is operating abnormally, this can be easily recognized by anyone using the timepiece, making it possible to prevent the user from unknowingly reading the incorrect time.

11) The mainspring 1*a* is prevented from being unwound more than is necessary by the hand lock mechanism 80. As an example the mainspring 1*a* is unwound more than is necessary when the number of windings lies in the range of from O to B in FIG. 22. By thus limiting the amount of unwinding, the winding-up operations can be carried out for a shorter time.

12) Since the hand-adjusting lock mechanism 90 does not allow hand adjustments until the mainspring 1*a* is sufficiently wound up, the time from completion of hand adjustments to restopping of the timepiece can be maximized, thereby providing an easy to use electronic control type mechanical timepiece.

13) Since the hand-adjusting lock mechanism 90 is provided, when the output torque on the mainspring 1*a* is reduced and the electronic control type mechanical timepiece stops, the system stopping time which continues until the mainspring la is sufficiently wound up, that is, until hand adjustments can be performed, can be made sufficiently long. Here, while the mainspring 1*a* is being wound up by hand, torque is intermittently output from the mainspring 1*a*, causing actuation of the generator, so that when the time which continues until the winding up of the mainspring 1*a* is completed is long, the generator 20 causes a charging portion, such as a capacitor, to be charged with a high voltage. Therefore, in order to perform hand adjustments when the hands are stopped, that is, when the generator 20 is stopped, the system can be kept driven by means of the capacitor for a longer period of time. Thus if hand adjustments are completed within the usual amount of time, the system can be kept driven until the generator starts to operate.

Accordingly, the system can be controlled from immediately after hand adjustments, so that hand movement can be controlled with high precision.

When hand adjustments are completed within a predetermined amount of time, a certain amount of electrical power remains in the capacitor so that when the generator 20 is actuated after hand adjustments are completed, the capacitor can be charged more quickly than in conventional timepieces. Therefore, time lag of control circuit driving can be made short, thereby reducing errors in time control to allow more precise hand adjustments.

14) The lock mechanism 70 and 90 are automatically actuated in response to the winding up of the mainspring 1*a* so that the operator does not have to worry about operating them, making it possible to facilitate operation. Similarly, the hand lock mechanism 80 is automatically actuated in response to the winding up of the mainspring 1*a*, so that the operator does not have to operate it by hand, as a result of which the timepiece can be operated more easily.

15) The levers 71 and 91 of their respective lock mechanisms 70 and 90 are made integral, so that the number of parts and costs can be reduced.

16) The hand-adjusting lock mechanism 90 locks the hand adjusting mechanism 44 so that it cannot operate due to engagement of the hand-adjusting lock lever 91 with the sliding pinion 35. The crown (winding stem 31) is itself locked and cannot be pulled. This allows the user to easily recognize that the hand adjusting mechanism 44 is locked, making it possible for the user to intuitively and easily operate the hand-adjusting lock mechanism 90.

Figure 6:
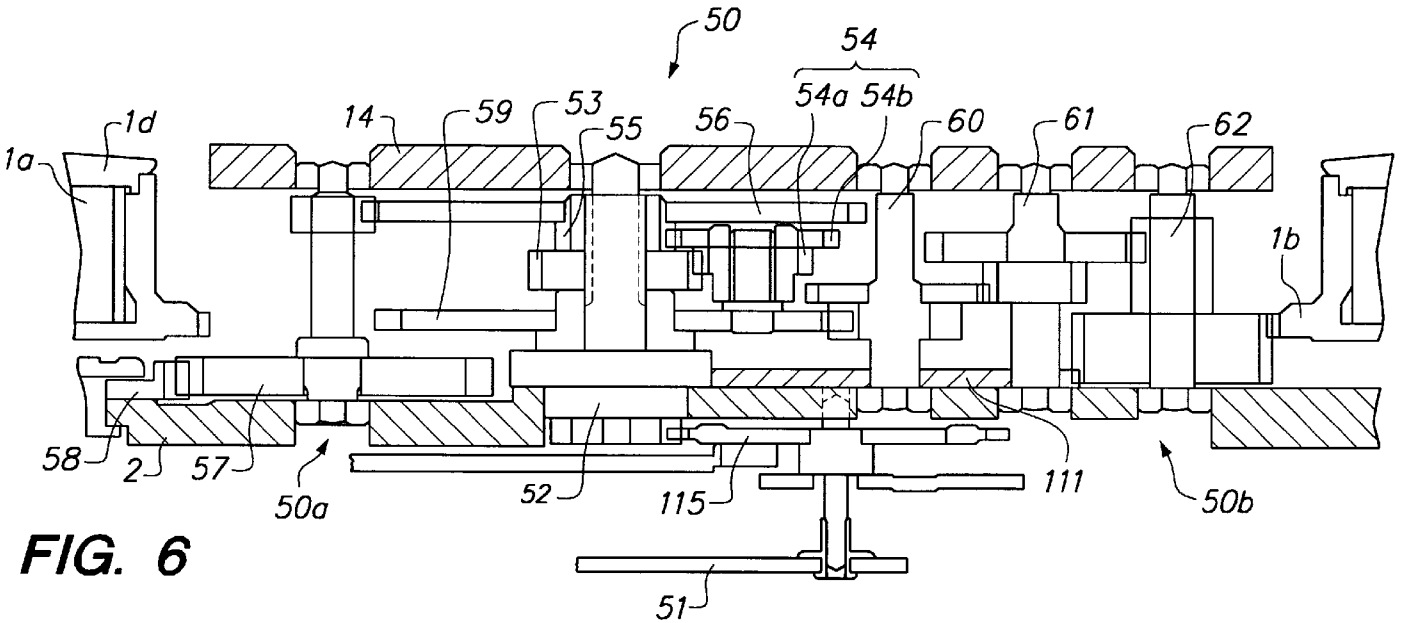
FIG. 6 is a sectional view of a second embodiment of the electronic control type mechanical timepiece in accordance with the present invention.
Figure 7:
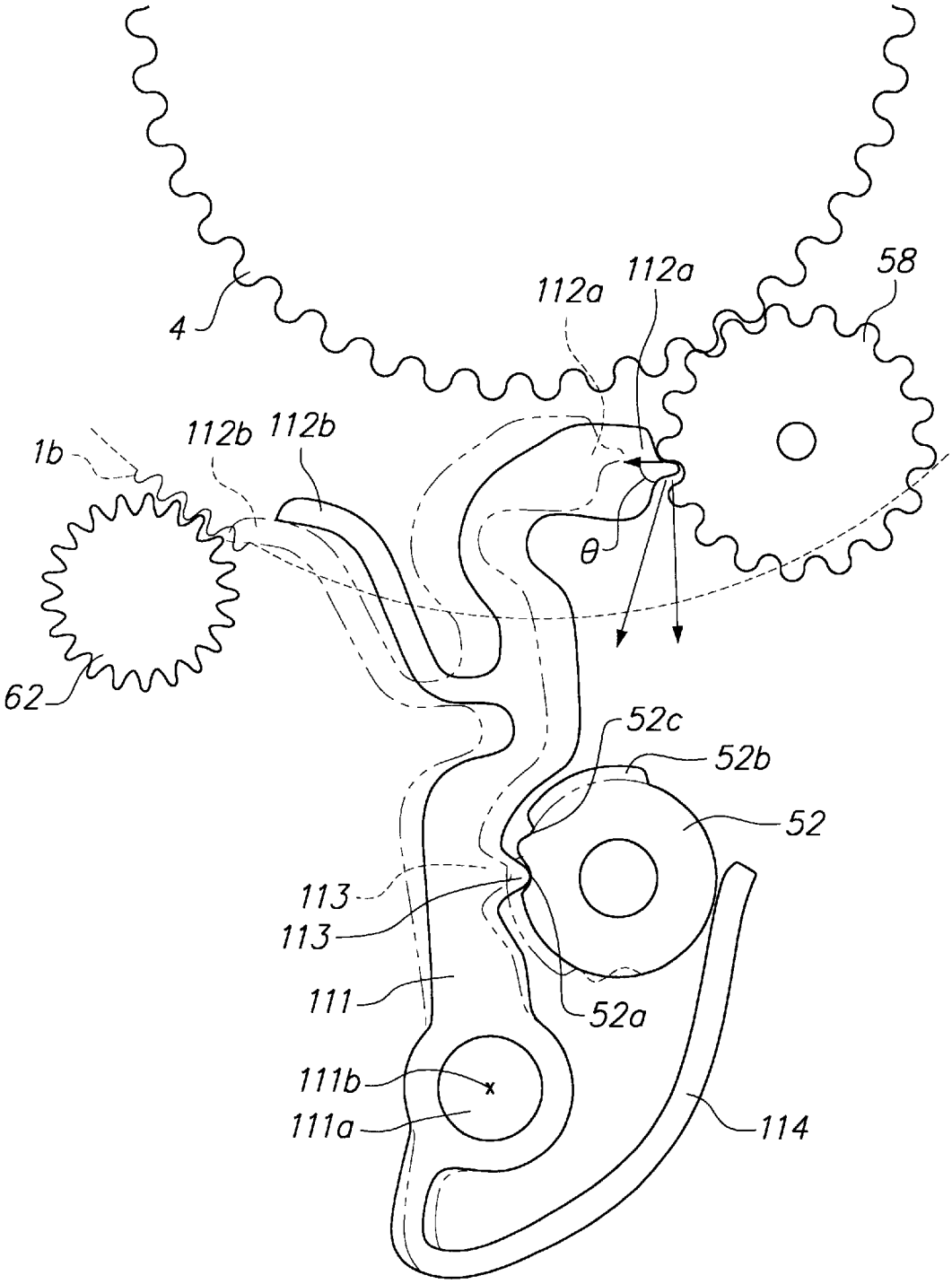
FIG. 7 is a schematic view of the main portion of each lock mechanism used in the second embodiment of the present invention.

FIGS. 6 and 7 illustrate a second embodiment of the timepiece in accordance with the present invention.

In the present embodiment, parts having the same operations as those of the first embodiment are given the same reference numerals, and will not be described below.

The present embodiment differs from the first embodiment in that the winding-up lock lever 71 and the hand lock lever 81 are integrally formed into a multilock lever 111. In other words, locking of the winding up operations and hand movements are performed by the multilock lever 111 alone.

In addition, the present embodiment differs from the first embodiment in that a hand-adjusting lock mechanism is not provided. Further, it differs from the first embodiment in that a speed reduction gear 115 meshes the eightieth wheel 52, with the power reserve needle 51 being mounted to a rotation shaft of the speed reduction gear 115. Still further, the form of arrangement of the eighty-second wheel 56 and the eighty-fifth wheel 59, and the form of arrangement of the wheels 60 to 62 are slightly different from those in the first embodiment.

The multilock lever 111 comprises a first stopper portion 112*a* which engages the eighty-fourth wheel 58; a second stopper portion 112*b* which engages the eighty-eighth wheel 62; and a spring 114 which extends to a side of the rotation shaft 111*a* opposite to the end where the stopper portions 112*a* and 112*b* are disposed.

The first stopper portion 112*a* of the multilock lever 111 is a rigid lever formed with the body. The angle θ of the force of the engaging portion thereof is set so that it is at least 70° with respect to a rotation center 111*b* of the rotation shaft 111*a*, allowing the engaging portion to properly engage the eighty-fourth wheel 58.

The second stopper portion 112*b* is resilient, so that even when it is pressed against the eighty-eighth wheel 62 while it engages the eighty-eighth wheel 62, it absorbs the pushing force, thereby preventing breakage of, for example, the teeth or shaft of the eighty-eighth wheel 62 or the rotation shaft 111*a*.

The spring portion 114 is greatly bent towards the eightieth wheel 52, and one end of the spring portion 114 and the engaging protrusion 113 press and clamp both sides of the eightieth wheel 52 about its circumference.

The eightieth wheel 52 has a groove 52*a* which engages the engaging protrusion 113 of the multilock lever 111, a protuberance 52*b* with a predetermined length in the circumferential direction, and a groove 52*c* provided therebetween. The groove 52*a*, the protuberance 52*b*, and the groove 52*c* compose a cam.

Figure 8A:
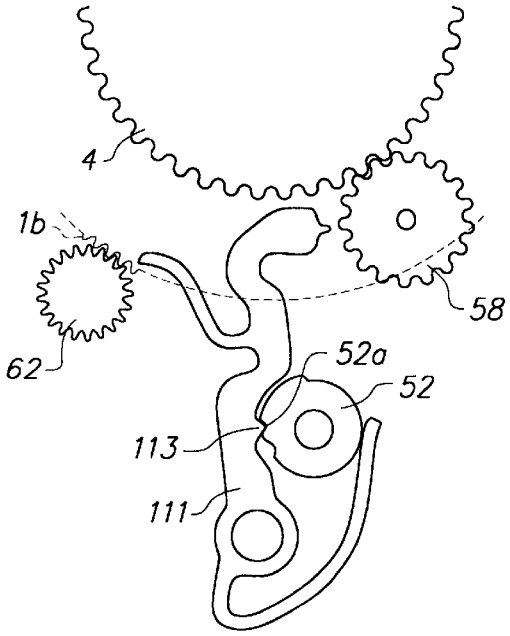
FIG. 8 illustrates the operation of each lock mechanism used in the second embodiment of the present invention.
Figure 8B:
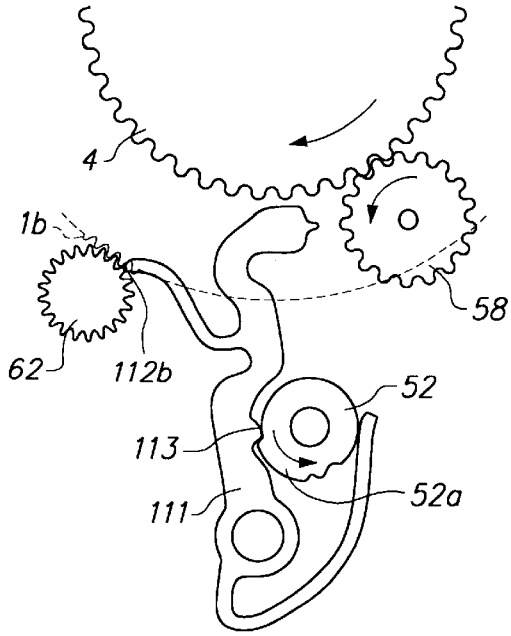
Figure 8C:
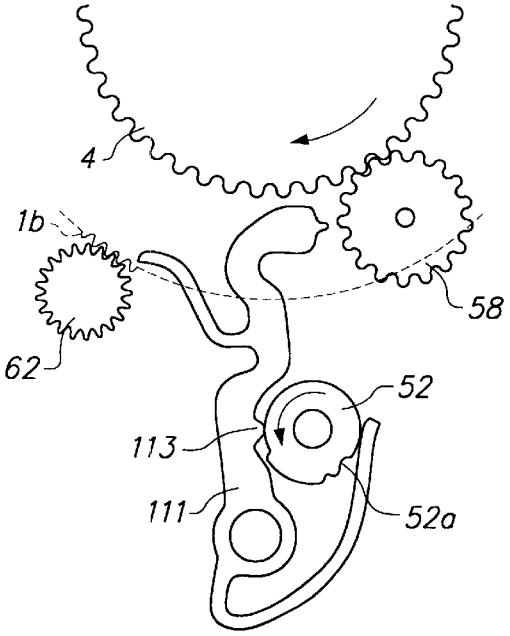

When the multilock lever 111 is installed with the eightieth wheel 52 as shown in FIG. 8(A), the multilock lever 111 operates in response to the rotation of the eightieth wheel 52 as shown in FIGS. 8(B) to 8(C).

More specifically, as shown in FIG. 8(A), when the mainspring 1*a* is not wound up at all so that the torque is zero, the multilock lever 111 is installed on the rotation shaft 111*a*, with the engaging protrusion 113 in contact with the groove 52*a* of the eightieth wheel 52. As shown in FIG. 8(B), the eightieth wheel 52 is then rotated in the direction of the arrow by winding up the mainspring 1*a*. During the rotation, the engaging protrusion 113 moves onto one end of the protuberance 52*b*. In response to this, the multilock lever 111 progressively rotates towards the eightieth wheel 62, causing the second stopper portion 112*b* to slowly engage the teeth of the eighty-eighth wheel 62. When the engaging protrusion 113 drops down from the other end of the protuberance 52*b*, the second stopper portion 112*b* separates from the eighty-eighth wheel 62.

Here, the length of the protuberance 52*b* in the circumferential direction is in correspondence with the number of windings O to B, illustrated in FIG. 22. From the time the engaging protrusion 113 moves onto the protuberance 52*b* to the time it drops down therefrom, torque by an amount equal to the lower limit of the set range is accumulated in the mainspring 1*a* by winding up the mainspring 1*a*.

Figure 8D:
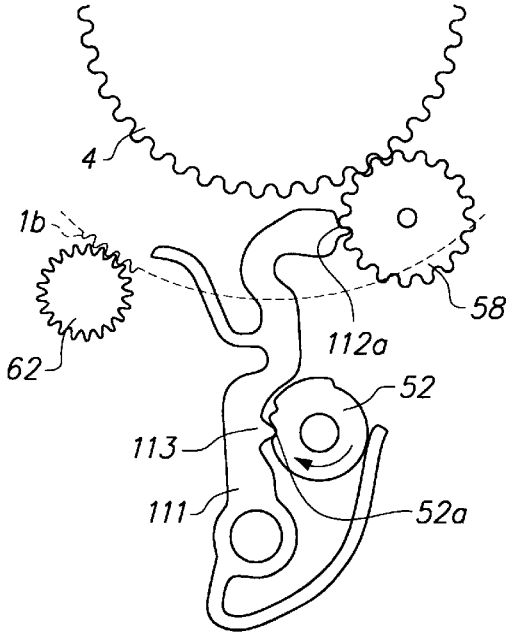

Thereafter, as shown in FIG. 8(C), when the mainspring 1*a* is further wound up, the eightieth wheel 52 rotates further, causing the groove 52*a* to move towards the engaging protrusion 113. When, during the rotation, the number of windings of the mainspring 1*a* reaches the number of windings A in FIG. 22, the engaging protrusion 113 engages groove 52*a*, and, at the same time, the first stopper portion 112*a* of the multilock lever 111 engages the eighty-fourth wheel 58, as shown in FIG. 8(D). This locks the rotation of the winding-up wheel train 50*a* (of FIG. 6), so that the winding up of the mainspring 1*a* is stopped.

Figure 9A:
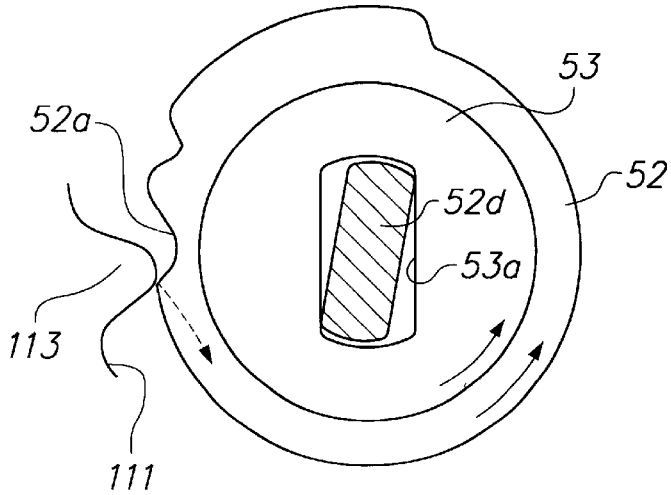
FIG. 9 is an enlarged view of the component parts of each lock mechanism used in the second embodiment of the present invention.
Figure 9B:
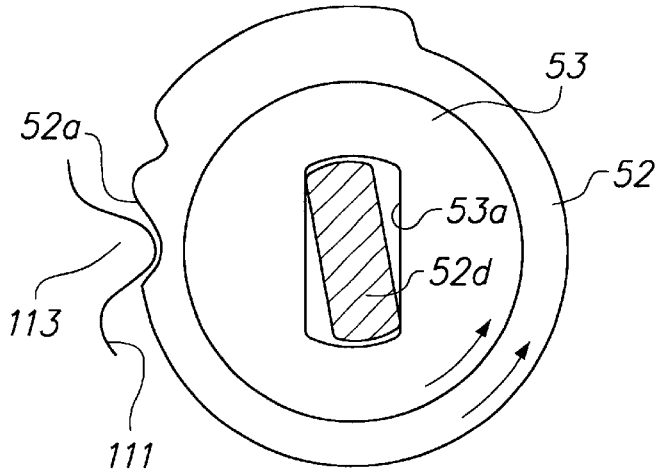

In this embodiment, as shown in FIG. 9, a rod portion 52*d*, provided at the rotation shaft of the eightieth wheel 52, is fitted, with a predetermined amount of backlash, into a correspondingly shaped hole 53*a* of the power reserve wheel 53 that transmits torque to the rod portion 52*d*. Therefore, when the mainspring 1*a* is being wound up, the eightieth wheel 52 and the power reserve wheel 53 rotate together, with the backlash being occupied by rod portion 52*d* as shown in FIG. 9(A). Just before the engaging protrusion 113 of the multilock lever 111 engages the groove 52*a* of the engaging protrusion 113, a moment is produced (indicated by an alternate long and two short dashed line arrow in FIG. 9) that acts on the engaging portion of the eightieth wheel 52 to rotate wheel 52. As shown in FIG. 9(B), this causes eightieth wheel 52 to rotate an amount corresponding to the backlash without rotating the power reserve wheel 53. As a result, engagement of the engaging protrusion 113 with the groove 52*a*, as well as engagement of the first stopper portion 112*a* with the teeth of the eighty-fourth wheel 58, takes place instantaneously.

Referring back to FIG. 8, after winding up of the mainspring 1*a* is stopped and the mainspring 1*a* is unwound as the hands of the timepiece move during ordinary use, the eightieth wheel 52 rotates in the direction of the arrow in FIG. 8(D) and torque is output from the mainspring 1*a* during rotation from the position of FIG. 8(C) to the position of FIG. 8(B). At the moment the eightieth wheel 52 rotates to the position of FIG. 8(B), the multilock lever 111 locks the rotation of the unwind wheel train 50*b*, so that the unwinding of the mainspring 1*a* and movement of the hands stops.

In other words, when the timepiece is ordinarily used, the eightieth wheel 52 rotates in a reciprocating manner.

The part of the timepiece of the second embodiment that is structured in essentially the same way as the timepiece of the first embodiment produces similar effects to those of the timepiece of the first embodiment. The part of the timepiece of the second embodiment which is structured differently from the timepiece of the first embodiment produces the following characteristic effects.

17) Since the multilock lever 111 is an integral structure of the winding-up lock lever 71 and the hand lock lever 81 of the first embodiment, fewer parts are required and more efficient use of space can be made, as compared with the first embodiment.

18) Since the engaging protrusion 113 and one end of the spring portion 114 of the multilock lever 111 press and clamp both sides of the eightieth wheel 52 about its circumference, the rotation shaft of the eightieth wheel 52 is held in place, increasing its durability.

19) Since the spring portion 114 of the multilock lever 111 presses the eightieth wheel 52, the stopper pins 75 and 85, used in the first embodiment, can be eliminated, thereby reducing the number of parts.

20) After the second stopper portion 112*b* starts to contact the eighty-eighth wheel 62, the multilock lever 111 rotates a small amount towards the eighty-eighth wheel 62 until the engaging protrusion 113 completely moves onto the protuberance 52*b*. This means that during the rotation the second stopper portion 112*b* presses against the teeth of the eighty-eighth wheel 62. However, since the second stopper portion 112*b* is resilient, the pressing force is absorbed by the resilient second stopper portion 112*b*. This prevents undue pressing force from acting on the teeth of the eighty-eighth wheel 62 and reduces breakage of the teeth or shaft.

21) The first stopper portion 112*a* of the multilock lever 111, which is rigid, can reliably lock the eighty-fourth wheel 58 with greater drag force.

The eightieth wheel 52 is mounted with backlash on the power reserve wheel for rotation with the power reserve wheel 53, which transmits torque to the eightieth wheel 52. When the multilock lever 111 is operating, the eightieth wheel 52 rotates ahead of the power reserve wheel 53 by an amount corresponding to the backlash so that the engaging protrusion 113 of the multilock lever 11 can instantaneously drop into the groove 52*a*. In response to this, the first stopper portion 112*a* instantaneously engages the teeth of the eighty-fourth wheel 58. Therefore, the first stopper portion 112*a* and the teeth of the eighty-fourth wheel 58 do not slide against each other. Thus, even when the first stopper portion 112*a* is rigid, frictional force, or the like, against the teeth of the eighty-fourth wheel 58 can be reduced.

22) A speed reduction gear 115 meshes the eightieth wheel 52, and power reserve needle 51 is mounted to the rotation shaft of the speed reduction gear 115. Therefore, the range of rotation of the power reserve needle 51 can be restricted to within predetermined angles, a cam can be formed along nearly the entire circumference of the eightieth wheel 52, so that the precision with which torque is detected can be increased in correspondence with the amount by which the cam forming range is made larger.

FIGS. 10 to 13 each illustrate the main portion of an automatic winding type timepiece, in accordance with a third embodiment of the present invention.

Figure 10:
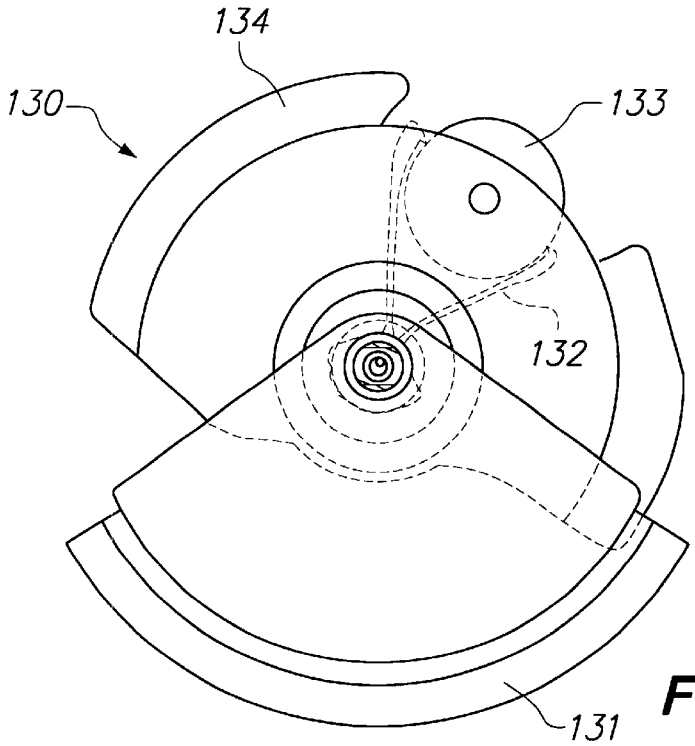
FIG. 10 is a plan view of the main portion of the timepiece in accordance with a third embodiment of the present invention.
Figure 11:
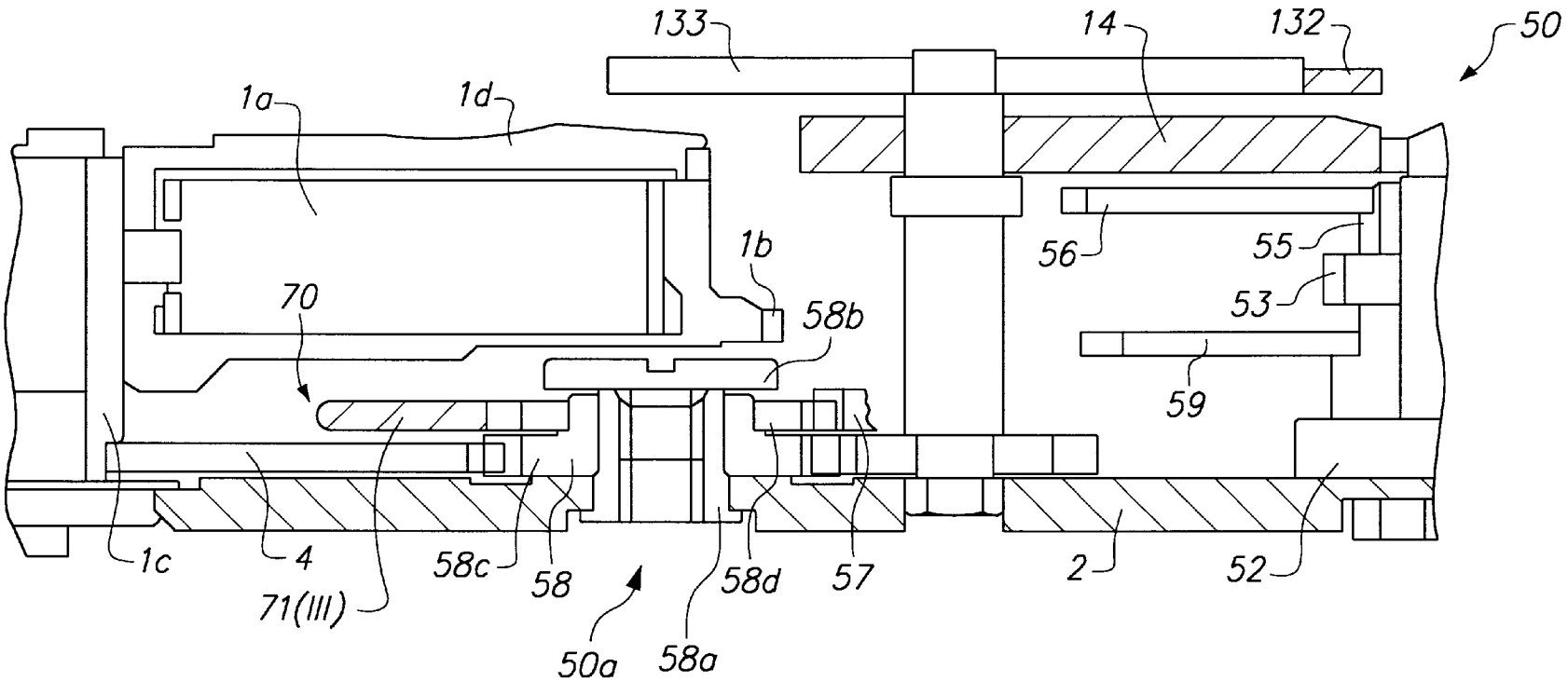
FIG. 11 is a sectional view of the main portion of the timepiece in accordance with the third embodiment of the present invention.

The timepiece of this embodiment is an automatic winding type timepiece, and comprises an automatic winding mechanism 130 of FIG. 10. The automatic winding type mechanism 130 is conventionally known in the automatic winding type timepiece field. In an automatic winding type mechanism, rotation of an oscillating weight 131 is transmitted to a pawl lever 132 in order to cause a transmission wheel 133 to always rotate in one directional regardless of the direction of rotation of the oscillating weight 131. Reference numeral 134 denotes a transmission receiver.

The timepiece of the present embodiment comprises the aforementioned winding-up lock mechanism 70, in which the winding-up lock lever (or the multilock lever 111) engages the eighty-fourth wheel 58 of the winding-up wheel train 50*a*. The transmission wheel 133 is coupled to the eighty-fourth wheel 58, so that rotation of the oscillating weight 131 is transmitted to the eighty-fourth wheel 58 through the transmission wheel 133 to rotate the ratchet wheel 4 and winding-up the mainspring 1*a*. Here, a slip mechanism (or a first slip mechanism), which is not shown and generally used in an automatic winding type timepiece, is provided between the ratchet wheel 4 and the barrel arbor 1*c*.

The eighty-fourth wheel 58 engages the winding-up lock lever 71. It includes a screw pin 58*a* which is erected at the main plate 2; a screw 58*b* which is screwed into the screw pin 58*a*; a first gear 58*c* which is rotatively fitted to the screw pin 58*a* and engages the ratchet wheel 4; and a second gear 58*d* which is fitted to the shaft of the first gear 58*c* and engages the eighty-third wheel 57. The first gear 58*c* engages the transmission wheel 133, and the teeth of the second gear 58*d* engage the stopper portion of the winding-up lock lever 71.

Figure 12:
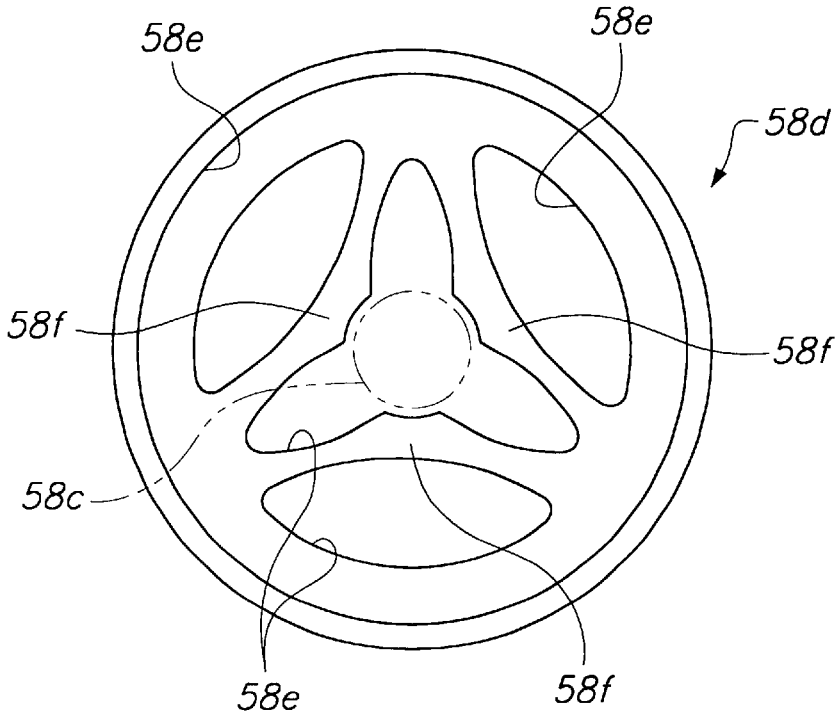
FIG. 12 is a plan view of component parts of the timepiece in the third embodiment of the present invention.
Figure 13:
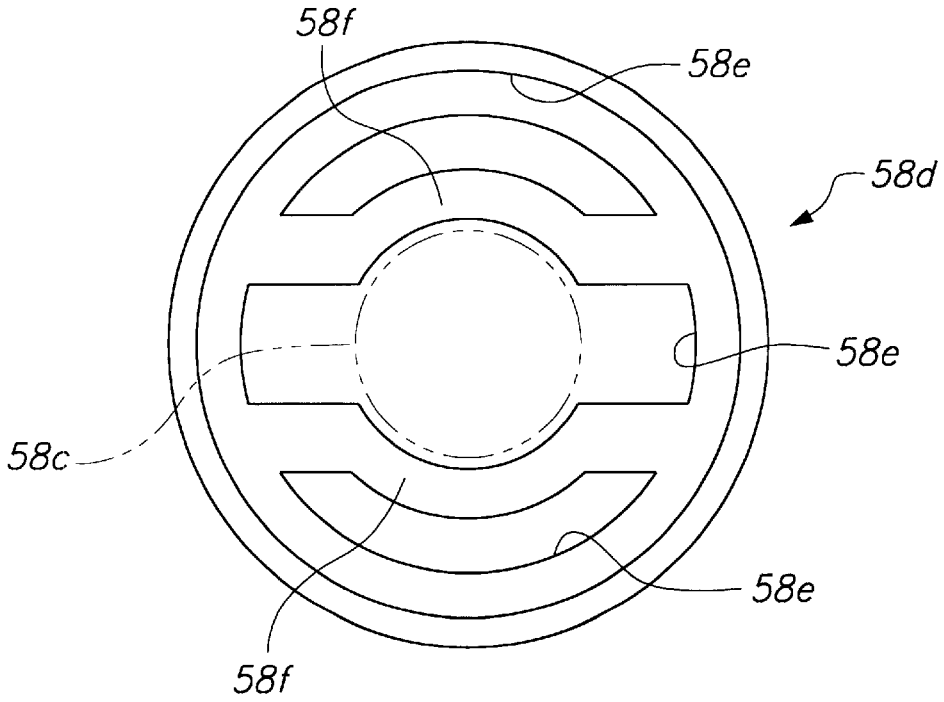
FIG. 13 is a plan view of a modification of the component parts of the timepiece in the third embodiment of the present invention.

Of these parts, the second gear 58*d* has a cutout portion 58*e*, which causes the second gear 58*d* to have a net-like form, as shown in FIGS. 12 and 13. It also has a resilient contact portion 58*f* that presses against and supports the shaft of the first gear 58*c*, about its circumference. The resilient contact portion 58*f* thereby forms a second slip mechanism.

According to such a timepiece, when the mainspring 1*a* is not wound to the number of windings A of FIG. 22 (that is, the second gear 58*d* of the eighty-fourth wheel 58 is not locked by the winding-up lock lever 71), the second gear 58*d* rotates with the first gear 58*c*. The mainspring 1*a* is wound up as a result of the rotation of the oscillating weight 131, and the rotation is transmitted from the eighty-third wheel 57 through the winding-up wheel train 50*a*, thereby allowing the power reserve needle 51 (of FIG. 4) to rotate.

On the other hand, when the mainspring 1*a* is wound up to the number of windings A of FIG. 22, the second gear 58*d* is locked by the winding-up lock lever 71, so that the first gear 58*c* overcomes the force supporting the contact portion 58*f* and rotates, causing slipping to occur between the first gear 58*c* and the second gear 58*d*. As a result, although the first gear 58*c* rotates, the rotation of the oscillating weight 131 is not transmitted to the winding-up wheel train 50*a*. As the first gear 58*c* rotates, the ratchet wheel 4 rotates, but since the first slip mechanism is actuated when the mainspring 1*a* is wound to the number of windings A, the rotation of the ratchet 4 is not transmitted to the mainspring 1*a*. In other words, while the winding-up lock mechanism 70 is being actuated, the oscillating weight 131 rotates idly as the first gear 58*c* and the ratchet wheel 4 rotate.

The part of the timepiece of the third embodiment that is structured in essentially the same way as the timepieces of the first and second embodiments produces similar effects to those of the first and second embodiments. The part of the timepiece of the third embodiment that is structured differently from the timepieces of the first and second embodiments produces the following effects.

23) When the eighty-fourth wheel 58 is locked by the winding-up lock mechanism 70, each of the slip mechanisms is actuated, thereby preventing the oscillating weight from breaking as a result of locking operations. In addition, since the rotation of the oscillating weight 131 is not transmitted to the eightieth wheel 52, excessive force does not act on the winding-up lock mechanism 70 in a locked state, thereby preventing breakage of the winding-up lock mechanism 70 and reliably preventing transmission of the rotation of the oscillating weight 131 to the eightieth wheel 52. Therefore, it is possible to prevent the power reserve needle 51 (of FIG. 4), which is provided at the eightieth wheel 52, from rotating beyond the predetermined rotation range, so that correct indications can be reliably made. Consequently, the winding-up lock mechanism 70 can be effectively applied to an automatic winding type timepiece.

Figure 14:
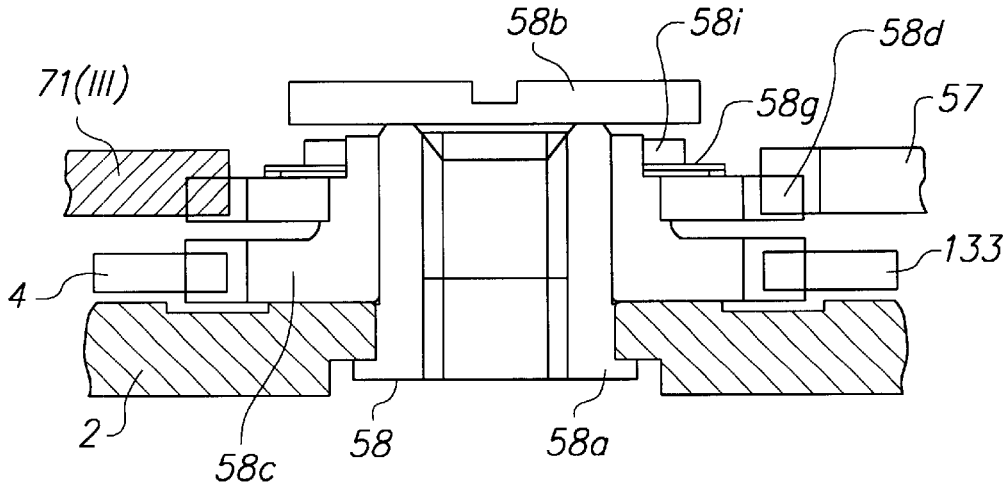
FIG. 14 is a sectional view of the main portion of the timepiece in accordance with a fourth embodiment of the present invention.

FIG. 14 illustrates a timepiece of a fourth embodiment of the present invention, showing a slip mechanism, which is a modification of the second slip mechanism used in the third embodiment of the present invention.

In the present embodiment, although the second gear 58*d* of the eighty-fourth wheel 58 is rotatively fitted to the shaft of the first gear 58*c*, the contact portion 58*f*, which is provided in the third embodiment, is not provided. The second gear 58*d*, used in the present embodiment, is formed such that it is pressed in the axial direction by a holding spring 58*g* affixed to the shaft of the first gear 58*c*, and rotates with the first gear 58*c* as a result of this pressing force.

Figure 15:
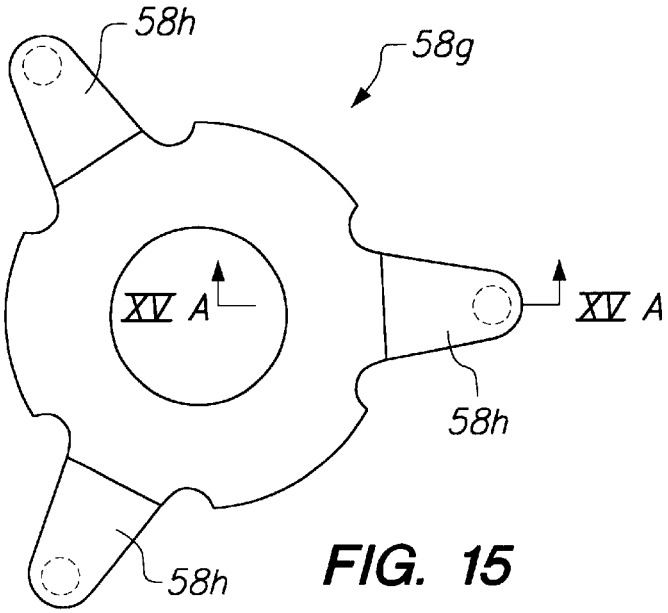
FIG. 15 is a plan view of component parts of the timepiece in the fourth embodiment of the present invention.
Figure 15A:
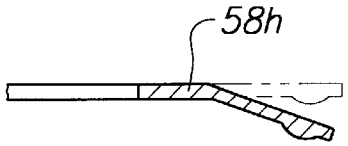
FIG. 15A is a cross-sectional view through the line XVA—XVA of FIG. 15.

As shown in FIG. 15, the holding spring 58*g* has a plurality of arms 58*h* that extend outward in a radial direction, with the arms 58*h* being bent towards the second gear 58*d*. When the arms 58*h* are brought into contact with the second gear 58*d*, they are forced back so as to extend virtually in a straight line, with the aforementioned pressing force being produced by the opposing resilient (spring) force. In other words, in the present embodiment, the holding spring 58*g* forms a second slip mechanism in accordance with the present invention. The holding spring 58*g* is affixed to the aforementioned shaft by a spring seat 58*i*.

According to this timepiece, when the second gear 58*d* of the eighty-fourth wheel 58 is not locked by the winding-up lock lever 71, the second gear 58*d* is pressed by the holding spring 58*g* so that it rotates with the first gear 58*c* in order to transmit the rotation of the oscillating weight, which is not shown, to the winding-up wheel train 50*a*, causing the power reserve needle (of FIG. 4) to rotate.

On the other hand, when the second gear 58*d* is locked by the winding-up lock lever 71, it overcomes the pressing force of the holding spring 58*g* and the first gear 58*c* tries to rotate so that slipping occurs between the second gear 58*d* and the holding spring 58*g*, as a result of which only the first gear 58*c* rotates integrally with the holding spring 58*g* and the spring seat 58*i*. Consequently, the rotation of the oscillating weight is not transmitted to the wheel train 50*a*.

According to the present embodiment, the timepiece comprises a second slip mechanism as does the timepiece of the third embodiment. Although in the timepiece of the fourth embodiment the structure of its second slip mechanism differs slightly from that of the second slip mechanism of the third embodiment, it produces essentially the same effects.

Figure 16:
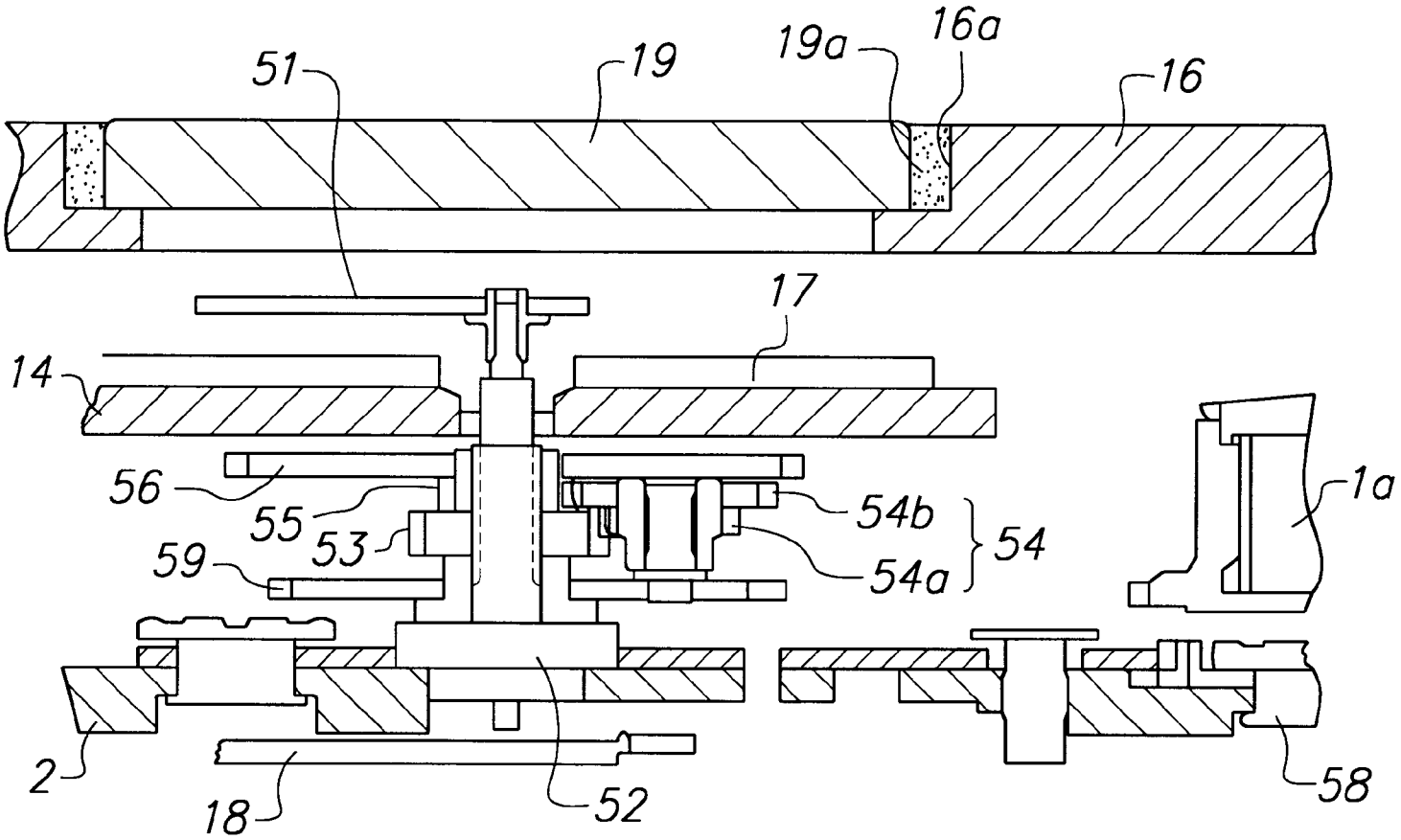
FIG. 16 is a sectional view of the main portion of the timepiece in accordance with a fifth embodiment of the present invention.

FIG. 16 illustrates a timepiece of a fifth embodiment of the present invention, showing the power reserve needle 51 at a different location. The power reserve needle 51 indicates the remaining life of the timepiece.

In the present embodiment, the power reserve needle 51 is not disposed at the outer side of the main plate 2, but at the outer side of a wheel train bridge 14, between the wheel train bridge 14 and a back cover 16. A dial 17, used specifically for the power reserve needle 51, is provided at the outer side face of the wheel train bridge 14, and a date indicator 18 is provided at the outer side of the main plate 2. As a remaining life indicator, in addition to the power reserve needle 51, a disk or other mechanism, such as a hologram whose color tone, pattern, or form changes, may also be used.

The back cover 16 is made of a metal material, such as stainless steel, platinum, titanium, gold (18K, 24K, etc.), hard alloy (such as Tic), or synthetic resin (such as ABS or polycarbonate (PC)), or ceramic. It has an opening 16*a* formed to correspond with the range of rotation of the power reserve needle 51. A transparent material 19, made of, for example, inorganic glass, sapphire, or acrylic, is fitted into the opening 16*a*, through a packing 19*a*. It allows the power reserve needle 51 to be viewed. It is to be noted that the separate transparent member 19 can be eliminated by forming the entire back cover 16 with a transparent material.

In the present embodiment, when a user wants to know, for example, when the mainspring 1*a* is to be wound or how much the mainspring 1*a* is wound (the remaining life), he or she can turn the timepiece over and view the position of the power reserve needle 51.

The present invention produces the following effects.

24) Since the power reserve needle 51 is provided at the back side, the design of the front side can be kept simple, while providing a remaining life confirmation function. In addition, by using the proper color tone or selected form for the remaining life indicator, the back side can be more properly designed.

25) Since the power reserve needle 51 is not provided at the outer side of the main plate 2, the eightieth wheel 52 and cooperating parts do not protrude at the outer side of the main plate 2, thereby allowing efficient use of this space and allowing the date indicator 18, etc., to be disposed therein. Therefore, a calendar function can be provided. In addition, when the power reserve needle 51 is provided in the space between the wheel train bridge 14 and the back cover 16, that space is efficiently used.

The present invention is not limited to the above-described embodiments, so that various modifications and changes can be made within the scope of the present invention.

Figure 17:
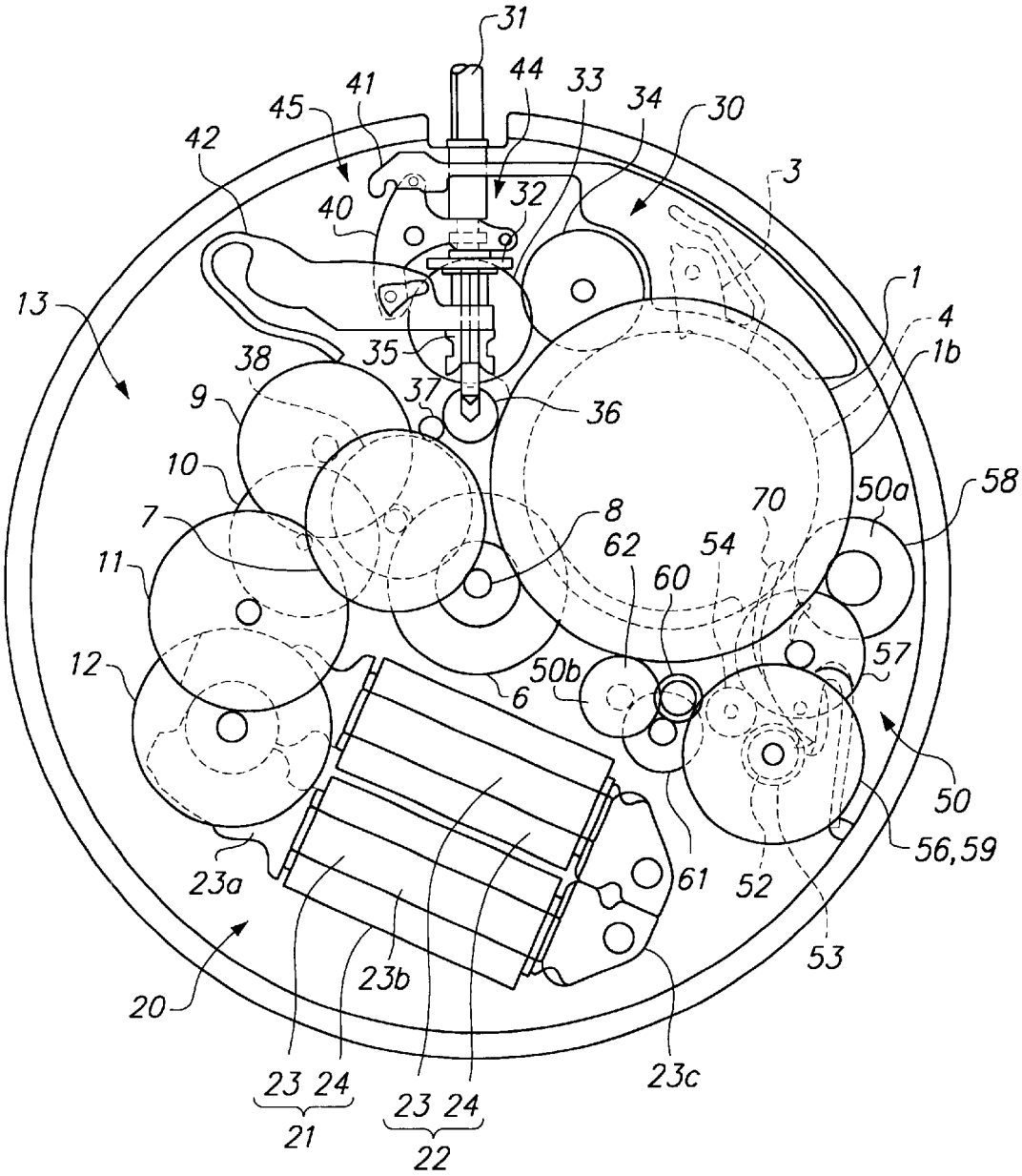
FIG. 17 is a plan view of a modification of the electronic control type mechanical timepiece in accordance with the present invention.
Figure 18:
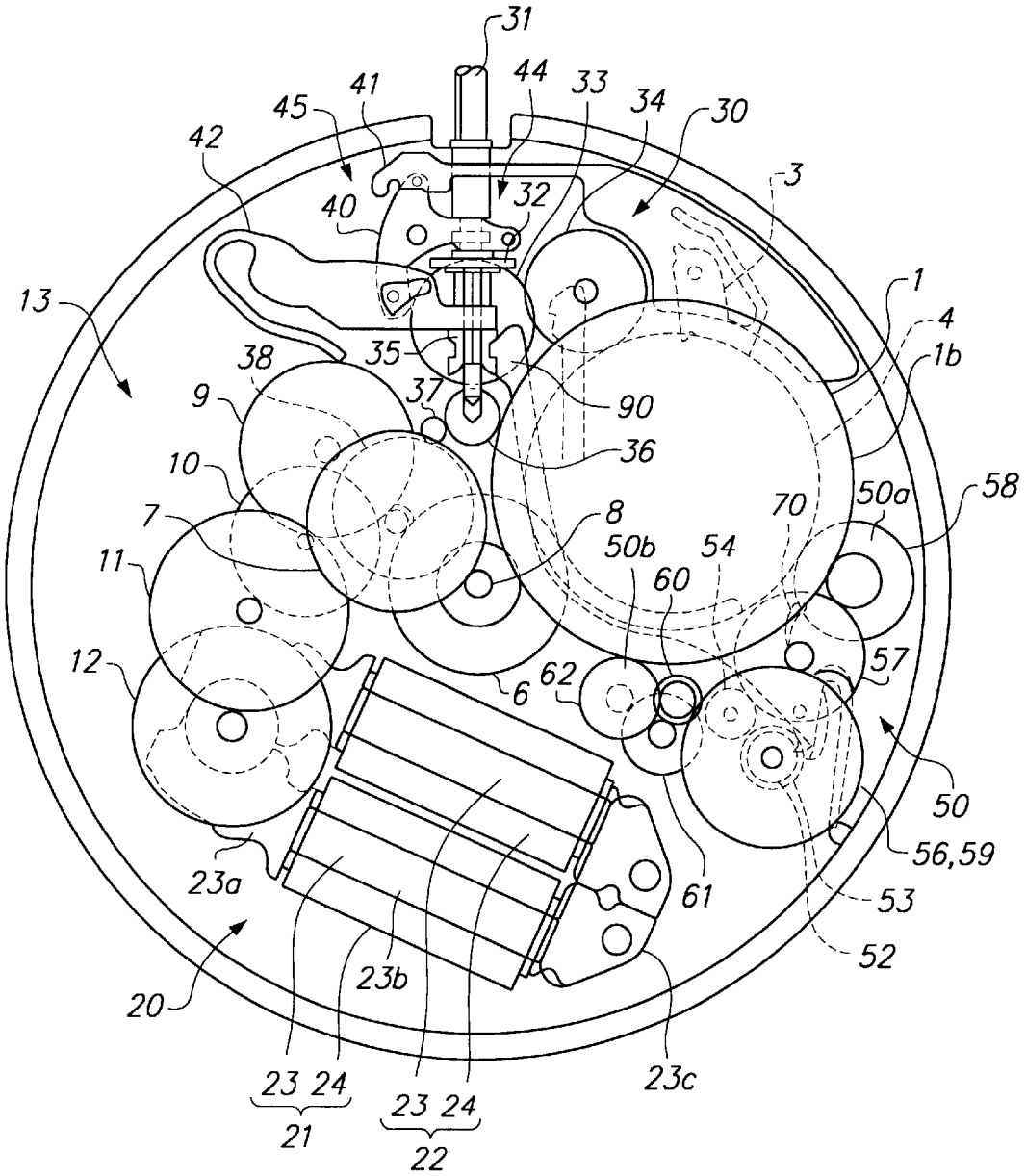
FIG. 18 is a plan view of another modification of the electronic control type mechanical timepiece in accordance with the present invention.
Figure 19:
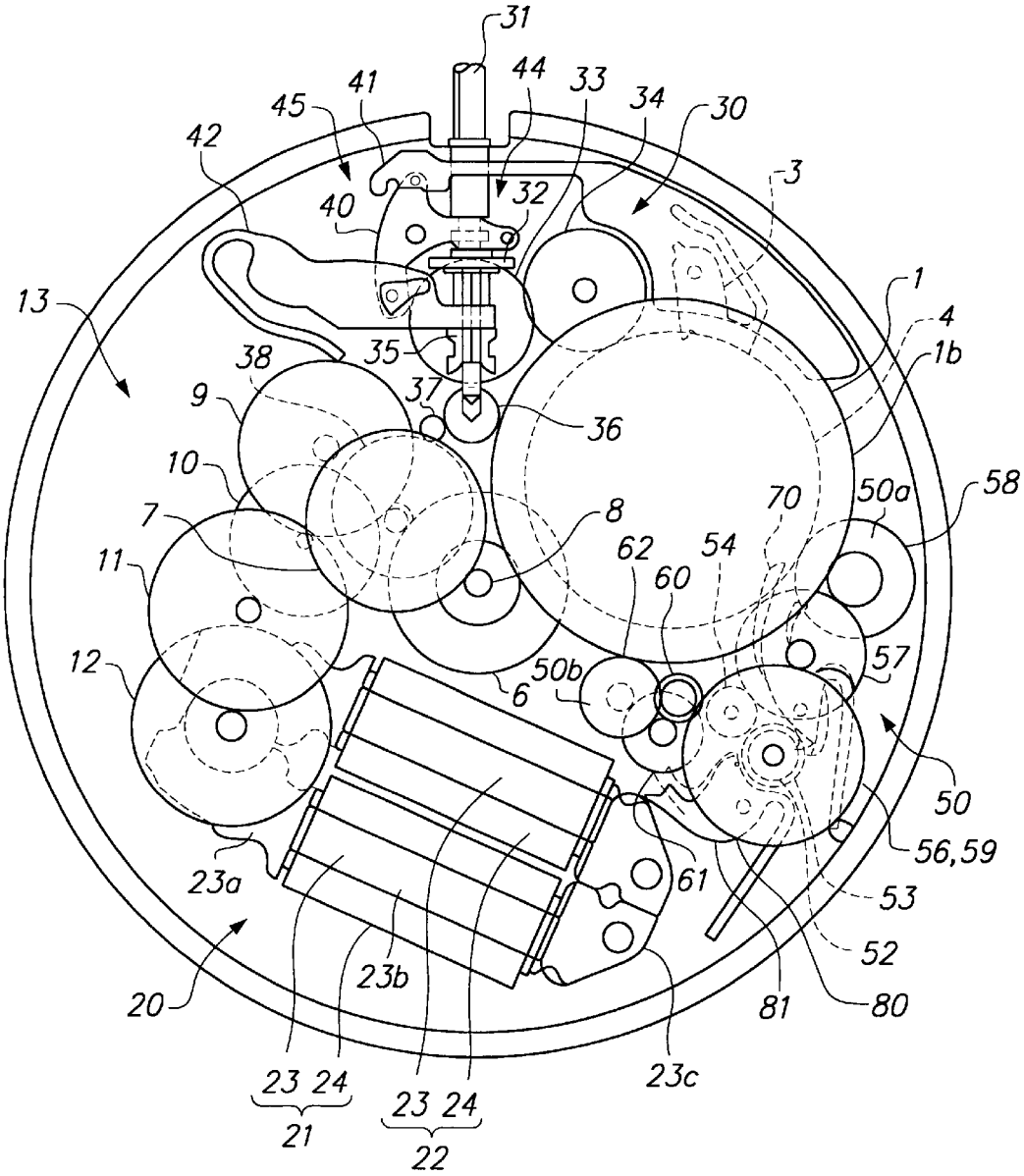
FIG. 19 is a plan view of still another modification of the electronic control type mechanical timepiece in accordance with the present invention.
Figure 20:
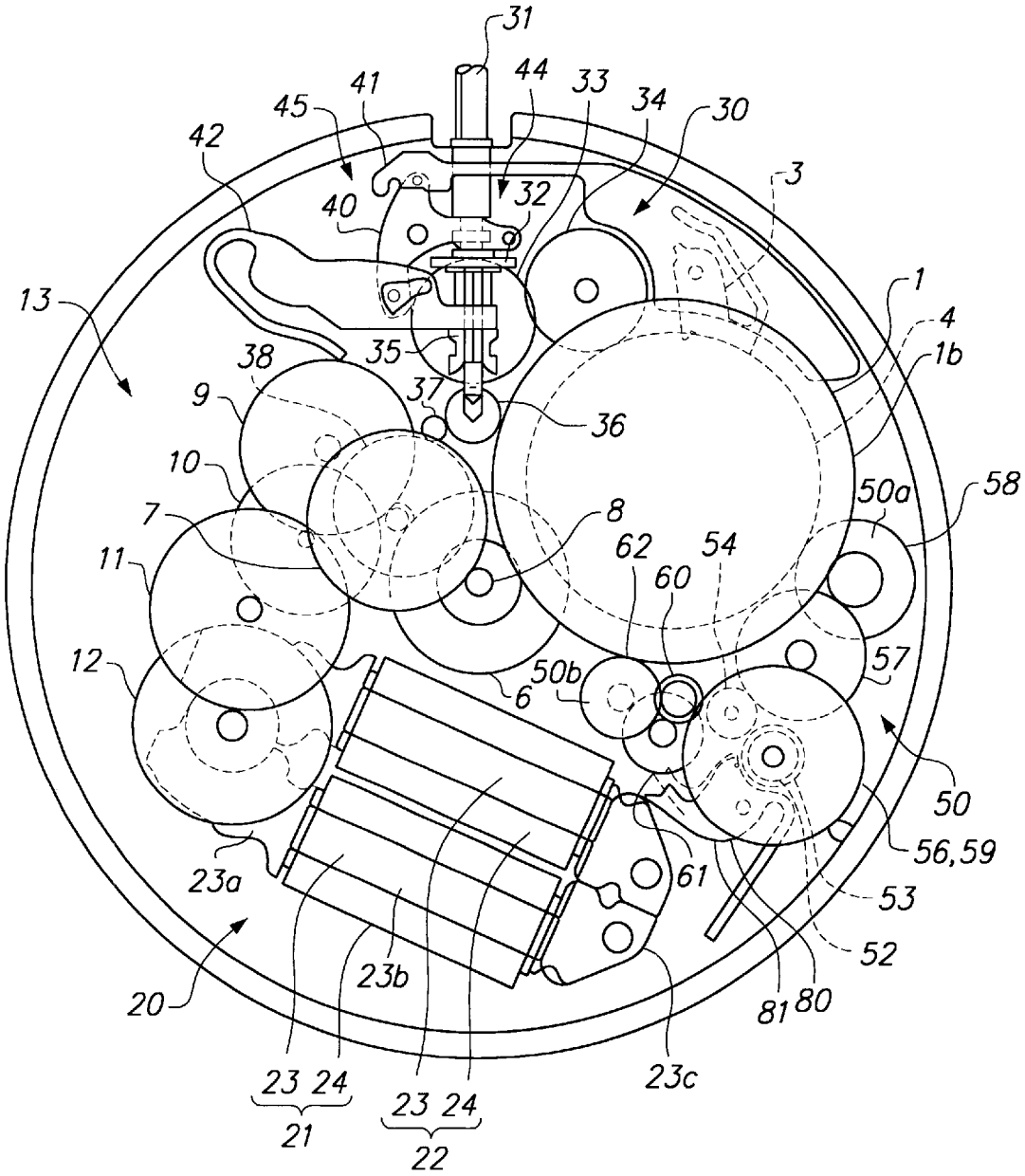
FIG. 20 is a plan view of still another modification of the electronic control type mechanical timepiece in accordance with the present invention.

Although in the foregoing description, three lock mechanisms, that is, the winding-up lock mechanism 70, the hand lock mechanism 80, and the hand-adjusting lock mechanism 90, are provided, only the winding-up lock mechanism 70 may be provided, as shown in FIG. 17, or only the winding-up lock mechanism 70 and the hand-adjusting lock mechanism 90 may be provided, as shown in FIG. 18. In addition, as shown in FIG. 19, only the winding-up lock mechanism 70 and the hand lock mechanism 80 may be provided. Further, as shown in FIG. 20, only the hand lock mechanism 80 may be provided. Although not illustrated, only the hand lock mechanism 80 and the hand-adjusting lock mechanism 90 may be provided. In short, the timepiece of the present invention only needs to include at least one of the winding-up lock mechanism 70 and the hand lock mechanism 80.

Although in the foregoing description the lever 71 of the winding-up lock mechanism 70 and the lever 91 of the hand-adjusting lock mechanism 90 are integrally formed, they may be separately formed. When the levers 71 and 91 are formed separately, the operation timing of the levers 71 and 91 may differ by varying the location of engagement of the engaging protrusions 73 and 93 of their respective levers 71 and 91 with the groove 52*a* of the eightieth wheel 52. For example, although in the above-described embodiments hand adjustments cannot be made until the winding-up operation is locked by the winding-up lock lever 71, the levers may be set such that hand adjustments can be made before the winding-up operation is locked if the number of windings of the mainspring 1*a* is more than the predetermined number of windings.

The detailed structure of the wheel train 50 is not limited those of the above-described embodiments, so that any structure, such as that incorporating a planetary mechanism, may be used as long as it can be used for adding and subtracting what is input from the ratchet wheel during winding-up operations and what is input from the movement barrel 1 during unwinding operations.

Although the winding-up lock mechanism 70 is described as employing the addition and subtraction wheel train 50, it may also be constructed so that it can lock the winding up of the mainspring 1*a* when the detected number of windings of the mainspring 1*a* exceeds a predetermined number of windings.

Similarly, although the hand lock mechanism is described as employing the addition and subtraction wheel train 50, it may also be constructed so that it can lock the unwinding of the mainspring 1*a* when the detected number of windings of the mainspring 1*a* becomes less than a predetermined number of windings.

Although in the foregoing description the winding-up lock mechanism 70 performs a locking operation as a result of engagement of the winding-up lock lever 71 with the eighty-fourth wheel 58, it may also perform a locking operation as a result of engagement of the lever 71 with a wheel of the winding-up portion 30 or a different wheel of the winding-up wheel train 50*a*. It is preferable to engage the lever 71 with a wheel that has a smaller torque than the ratchet wheel 4.

Similarly, although in the foregoing description the hand lock mechanism 80 stops the eighty-seventh wheel 61, it may stop either one of a wheel of the unwinding wheel train, and a wheel of the wheel train 13 that engages the generator 20. It is preferable to engage the lever 81 with a wheel that has a smaller torque than the movement barrel 1.

Although in the foregoing description the lock mechanisms 70 and 80, perform locking operations as a result of engagement of the stopper portions 72 and 82 of the levers 71 and 81 with their associated gears, respectively, it is possible to use a lock mechanism which press-contacts the outer periphery of a wheel of the wheel train 50 to perform a braking operation by, for example, frictional force generated by the press-contacting.

Although in the foregoing description the winding-up lock mechanism 70 locks the winding-up operation by controlling the rotation of a wheel, serving as torque transmitting part, of the winding-up portion 30 or a winding-up wheel train, it may lock the unwinding operation by engaging a component part of the winding-up portion 30 and disengaging gears of the winding-up portion 30, such as a winding pinion 32 and a crown wheel 33, so that unwinding operations cannot be performed.

Although in the foregoing description the hand-adjusting lock mechanism 90 locks the sliding pinion 35 to make it immovable for preventing operation of the winding stem 31, it may allow the winding stem 31 to be pulled out, but prevent hand adjustments from being performed as a result of separating parts, such as the setting wheel 36, of the hand-adjusting mechanism. In this case, the outer operating member, such as the crown (winding stem 31) itself, cannot be operated, so that unlike the case where the outer operating member is locked, an undue force will not be exerted onto the outer operating member by a user operating it by force. Therefore, such a hand-adjusting lock mechanism has the advantage that an excessive force will not be exerted onto the outer operating member, etc.

Although as a mechanism for driving a member which engages a component part of, for example, the winding-up portion 30 or the wheel train 13 it is preferable to use the so-called cam mechanism in which the levers 71, 81, and 91 rotate as the eightieth wheel 52 rotates, other types of actuating mechanisms may also be used.

Although in the first embodiment the groove 52*a* of the eightieth wheel 52 serves as an operation engaging portion, a protrusion, such as the protuberance 52*b* in the second embodiment, may be formed on the outer periphery of the eightieth wheel 52 so as to serve as the operation engaging portion. In short, the operation engaging portion is formed such that the levers 71, 81, and 91 are actuated at a predetermined timing as the eightieth wheel 52 rotates.

The present invention may also be applied, in addition to an electronic control type mechanical timepiece, to a mechanical timepiece including an escape wheel, a pallet fork, a timed annular balance, etc. Since the electronic control type mechanical timepiece performs hand movement control using a liquid crystal oscillator more precisely than the mechanical timepiece, it is required to indicate time more precisely than the mechanical timepiece. Therefore, it is preferable that the electronic control type mechanical timepiece, in which effects due to changes in outside torque become noticeable, be provided with the winding-up lock mechanism of the present invention.

In the first and second embodiments, although the mainspring 1*a* is formed so as to be wound up at the winding-up portion by hand, it may be formed, as in the third and fourth embodiments, by an automatic winding-up device employing an oscillating weight. A movement barrel in which a slip mechanism (first slip mechanism) is actuated during automatic winding may also be used. In this case, it is preferable to provide a second slip mechanism at, for example, the eighty-fourth wheel 58.

Figure 21:
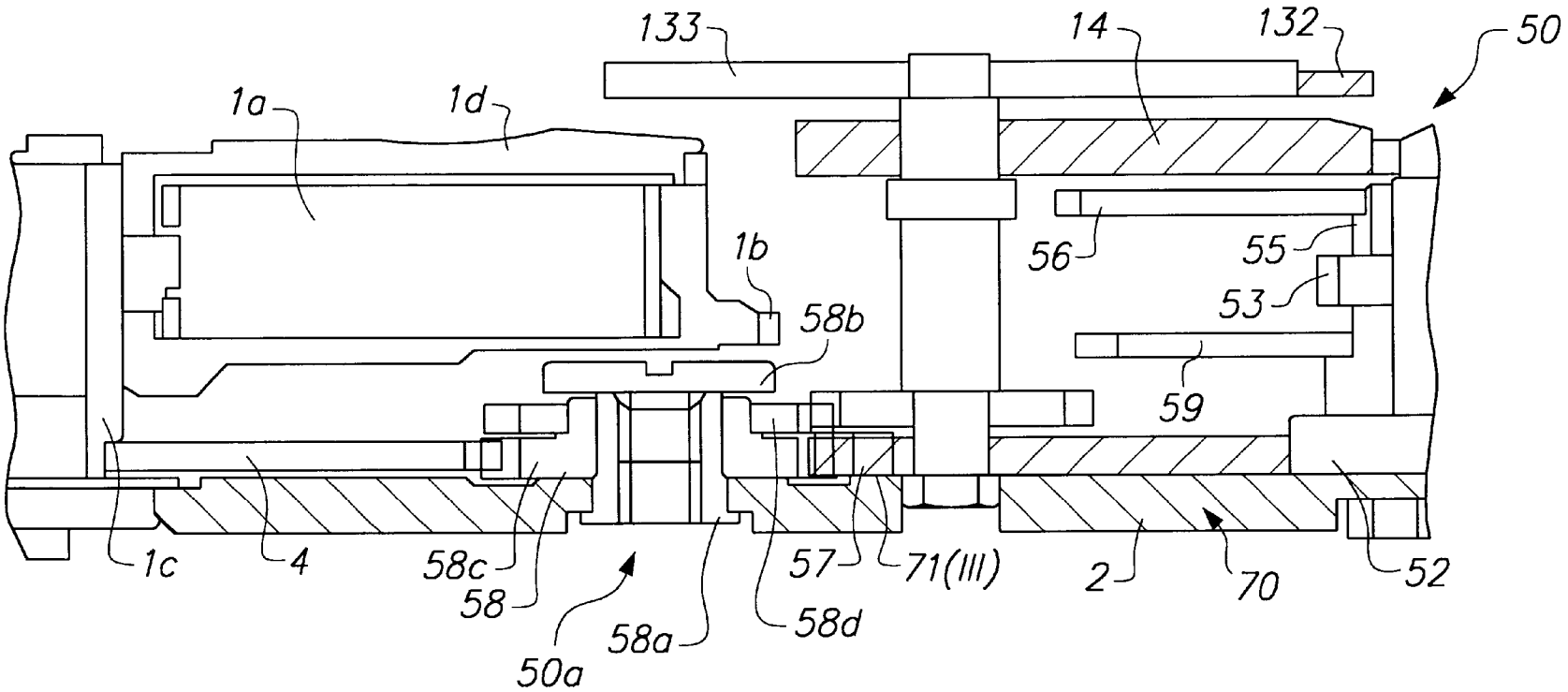
FIG. 21 is a sectional view of still another modification of the electronic control type mechanical timepiece in accordance with the present invention.

As shown in FIG. 21, when the eighty-third wheel 57 is brought into engagement with the first gear 58*c* of the eighty-fourth wheel 58 having a slip mechanism, the winding-up lock lever 71 is brought into engagement with the first gear 58*c*, and the transmission wheel 133 is brought into engagement with the second gear 58*d*, so that they are in a locked state, the oscillating weight can rotate idly with the rotation of the second gear 58*d*. In this case, the eighty-fourth wheel 58, as mentioned above, may be provided with the function of the aforementioned slip mechanism, so that the movement barrel can be formed with a simple structure. The slip mechanism may also be provided at the pinion portion, at the main plate 3 side, of the transmission wheel 133 to provide a slip mechanism function.

A separate lever, or the like, may also be provided, which operates in correspondence with the state of the winding-up lock mechanism and the winding-up lock lever 71 such that whether or not the winding-up operation is locked can be determined electronically, such as with an integrated circuit (IC). A signal may be applied to the IC in correspondence with whether or not the winding-up operation is locked by, for example, turning on a switch as a result of actuating this lever. By determining whether or not the winding-up operation is locked with an IC, the status of the mainspring torque (high or low) can be determined. Therefore, the IC can be used to control, for example, a pace-measuring pulse output only when mainspring torque, the power generating capacity, and the capacitor voltage are high. The pace-measuring pulse is used for confirming the precision of a circuit which draws electrical power other than for ordinary control operations.

Although the mainspring device of the present invention is used as a timepiece, it may also be used in, for example, a toy minicar, a metronome, or a music box, or anything else which employs a mainspring as a driving source.

As can be understood from the foregoing description, according to the present invention, a lock mechanism that employs an addition and subtraction wheel train is provided, so that even when small timepieces, such as watches, which have only a small space for disposing component parts in its interior, or other types of mainspring devices are used, the winding up of the mainspring or the unwinding of the mainspring can be stopped, so that a torque within a set range is consistently output from the mainspring.

In addition, according to the present invention, in electronic control type mechanical timepieces or other types of electronic control type mainspring devices, variations in output torque can be controlled, so that while the control circuit is not operating, precise corrections can be made, and, as mentioned above, torque within the set range can be output from the mainspring at all times.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A mainspring device that drives a primary wheel train by mechanical energy of a mainspring, comprising:

a winding-up portion that accumulates energy in said mainspring;

an addition-and-subtraction wheel train driven by addition and subtraction of accumulated energy corresponding to an amount by which the mainspring is wound up and unwound, respectively;

an addition-and-subtraction wheel, disposed in said addition-and-subtraction wheel train, that rotates in correspondence with an amount by which said mainspring is wound up and unwound, said addition-and-subtraction wheel having a single plane of rotation; and a lock mechanism actuated in response to the rotation of said addition-and-subtraction wheel to limit winding up and unwinding of said mainspring to a selected range of windings, and to thereby prevent transmission of torque having a value outside a set range from said mainspring to said primary wheel train.

2. A mainspring device according to claim 1, further comprising a winding-up wheel train that transmits torque to said addition-and-subtraction wheel train during winding-up operations of said mainspring, and wherein said lock mechanism comprises a winding-up lock mechanism portion that locks one of said winding-up wheel train and said winding-up portion in response to the rotation of said addition-and-subtraction wheel indicating that said mainspring is wound up to a number of windings equal to or greater than a first predetermined number of windings.

3. A mainspring device according to claim 2, comprising a winding-up torque transmitting component in one of said winding-up wheel train and said winding-up portion and wherein said winding-up lock mechanism portion locks said winding-up torque transmitting component to stop the winding up of said mainspring.

4. A mainspring device according to claim 3, comprising a gear directly connected to a torque input side of said mainspring and wherein said winding-up torque transmitting component locked by said winding-up lock mechanism portion provides a torque equal to or less than said gear.

5. A mainspring device according to any one of claims 1 to 4, further comprising an unwinding wheel train that transmits torque to said addition-and-subtraction wheel train during unwinding operations of said mainspring, and wherein said lock mechanism comprises an unwinding lock mechanism portion that locks one of said unwinding wheel train and said primary wheel train in response to the rotation of said addition-and-subtraction wheel indicating that said mainspring is unwound to a number of windings equal to or less than a second predetermined number of windings.

6. A mainspring device according to claim 5, comprising a gear in said primary wheel train that is disengaged by said unwinding lock mechanism portion to stop said primary wheel train.

7. A mainspring device according to claim 5, comprising an unwinding torque transmitting component in one of said unwinding wheel train and said primary wheel train, and wherein said unwinding lock mechanism portion locks said unwinding torque transmitting component to stop rotation of said primary wheel train.

8. A mainspring device according to claim 7, comprising an output-side gear directly connected to a torque output side of said mainspring and wherein said unwinding torque transmitting component locked by said unwinding lock mechanism portion provides a torque equal to or less than said output-side gear.

9. A mainspring device according to any one of claims 2 to 4, comprising an oscillating weight and a drive gear driven by rotation of said oscillating weight to wind up said mainspring, said drive gear being coupled to said winding-up wheel train, and wherein said winding-up lock mechanism portion locks a gear in said winding-up wheel train, and wherein said winding-up lock mechanism portion comprises a slip mechanism section for preventing transmission of torque, during actuation of said winding-up lock mechanism portion, from said oscillating weight to said mainspring and said addition-and-subtraction wheel.

10. A mainspring device according to claim 5, wherein said winding-up lock mechanism portion comprises a winding-up lock lever that engages at least one winding-up torque transmitting component; and wherein said unwinding lock mechanism comprises an unwinding lock lever that engages at least one unwinding torque transmitting component.

11. A mainspring device according to claim 10, wherein said winding-up lock lever comprises a stopper portion that engages at least one gear in one of said winding-up wheel train and said winding-up portion; and wherein said unwinding lock lever comprises a stopper portion that engages at least one gear in one of said unwinding wheel train and said primary wheel train.

12. A mainspring device according to claim 11, wherein said winding-up lock lever and said unwinding lock lever are integrally formed into a multilock lever.

13. A mainspring device according to claim 11, wherein said winding-up lock lever comprises a rotational center disposed between said addition-and-subtraction wheel and said gear engaged by the winding-up lock lever.

14. A mainspring device according to claim 11, wherein said unwinding lock lever comprises a rotational center disposed between addition-and-subtraction wheel and the gear engaged by said unwinding lock lever.

15. A mainspring device according to claim 11, wherein said addition-and-subtraction wheel comprises an operation engaging portion on its circumference; and wherein the winding-up lock lever comprises an engaging protrusion for engaging said operation engaging portion of said addition-and-subtraction wheel, the stopper portion of said winding lock lever being engaged with said gear in said one of said winding-up wheel train and winding-up portion in response to said engaging protrusion coming into engagement with said operation engaging portion.

16. A mainspring device according to claim 11, wherein said addition-and-subtraction wheel comprises an operation engaging portion on its circumference; and wherein said unwinding lock lever comprises an engaging protrusion for engaging the operation engaging portion of the addition-and-subtraction wheel, the stopper portion of said unwinding lock lever being engaged with said gear in said one of said unwinding wheel train and primary wheel train in response to said engaging protrusion coming into engagement with said operation engaging portion.

17. A mainspring device according to claim 10, wherein said winding-up lock lever comprises portions that clamp sides of said addition-and-subtraction wheel about its circumference.

18. A mainspring device according to claim 10, wherein said unwinding lock lever comprises portions that clamp sides of said addition-and-subtraction wheel about its circumference.

19. A mainspring device according to claim 11, wherein at least one of said winding-up lock stopper portion and said unwinding lock stopper portion is resilient.

20. A mainspring device according to claim 11, wherein at least one of said winding-up lock stopper portion and said unwinding lock stopper portion is rigid; and comprising a torque transmitting gear having a shaft, and wherein said addition-and-subtraction wheel is mounted on said shaft with backlash so that said addition-and-subtraction wheel rotates ahead of said torque transmitting gear by an amount corresponding to the amount of backlash when one of said winding-up lock lever and said unwinding lock lever is actuated.

21. A mainspring device according to claim 1, further comprising a remaining life indicator driven by said addition-and-subtraction wheel.

22. A mainspring device according to claim 21, comprising a wheel train bridge that supports said primary wheel train, and wherein said remaining life indicator is located at an outer side of said wheel train bridge.

23. A mainspring device according to claim 1, comprising a generator for converting the mechanical energy of said mainspring transmitted through said wheel train into electrical energy, and a rotation controller driven by the electrical energy to control a rotational period of said generator.

24. A mainspring device according to claim 1, comprising a hand connected to said primary wheel train.

25. An electronic control type mechanical timepiece comprising:

a mainspring that accumulates energy through actuation of a winding-up portion;

a generator for converting mechanical energy of the mainspring transmitted through a primary wheel train into electrical energy;

a hand connected to the primary wheel train;

an addition-and-subtraction wheel train driven by addition and subtraction of accumulated energy corresponding to an amount by which the mainspring is wound up and unwound, respectively;

an addition-and-subtraction wheel, disposed in said addition-and-subtraction wheel train, that rotates in correspondence with an amount by which the mainspring is wound up and unwound, said addition-and-subtraction wheel having a single plane of rotation and being rotatable about a stationary axis; and one of a winding-up lock mechanism that locks said winding-up portion to stop the winding up of said mainspring when said mainspring is wound up to a number of windings that is equal to or greater than a first predetermined number of windings, and an unwinding lock mechanism that locks the primary wheel train to stop hand movement when said mainspring is unwound to a number of windings that is equal to or less than a second predetermined number of windings.

26. A timepiece according to claim 25, further comprising a timepiece hand adjusting mechanism, and a hand-adjusting lock mechanism that locks the timepiece hand adjusting mechanism to prevent actuation of the timepiece hand adjusting mechanism when the mainspring is unwound to the number of windings that is equal to or less than the second predetermined number of windings.

27. A timepiece according to claims 25 or 26, further comprising;

a winding-up wheel train that transmits torque to said addition-and-subtraction wheel train during a winding-up operation;

wherein said winding-up lock mechanism is responsive to the rotation of said addition-and-subtraction wheel indicating that the mainspring is wound up to the number of windings that is equal to or greater than said first predetermined number of windings to lock one of said winding-up wheel train and said winding-up portion to stop winding up of the mainspring.

28. A timepiece according to claims 25 or 26, further comprising;

an unwinding wheel train that transmits torque to said addition-and-subtraction wheel train during a winding-down operation;

wherein said unwinding lock mechanism is responsive to the rotation of said addition-and-subtraction wheel indicating that said mainspring is unwound to the number of windings that is equal to or less than said second predetermined number of windings to lock one of said unwinding wheel train and said primary wheel train to stop unwinding of said mainspring.

29. A timepiece according to claim 25, further comprising a rotation control circuit that is driven by said electrical energy to control a rotation period of said generator.

30. A method of controlling a winding-up operation of a mainspring device having a mainspring and a generator for converting mechanical energy of the mainspring transmitted through a wheel train into electrical energy, said method comprising:

rotating an indicator wheel within a single rotation plane and along a stationary axis in accordance with the amount of winding applied to the mainspring;

winding-up the mainspring with a winding-up portion to a number of windings that is equal to or greater than a predetermined number of windings to accumulate energy in the mainspring, and when said indicator wheel indicates that the number of windings is equal to or greater than the predetermined number of windings, locking the winding-up portion with a winding-up lock mechanism in order to stop the winding up of the mainspring.

31. A method of controlling an unwinding operation of a mainspring device having a mainspring and a generator for converting mechanical energy of the mainspring transmitted through a wheel train into electrical energy, said method comprising:

rotating an indicator wheel within a single rotation plane and along a stationary axis in accordance with the amount of unwinding applied to the mainspring;

unwinding the mainspring to a number of windings that is equal to or less than a predetermined number of windings, and when said indicator wheel indicates that the number of windings is equal to or less than the predetermined number of windings, locking the wheel train with an unwinding lock mechanism in order to stop the rotation of the wheel train.

32. A method as in claims 30 or 31 wherein the mainspring device forms part of a timepiece.

33. A winding protection structure for a mechanical device having a mainspring, said winding protection structure comprising:

an indicator wheel having a single plane of rotation, being rotatable about a stationary axis, and being responsive to the winding and unwinding of said mainspring, said indicator wheel having a first directional rotation proportional to the winding of said mainspring and having a second directional rotation proportional to the unwinding of said mainspring, said first directional rotation being opposite said second rotational direction;

a first disabling mechanism responsive to said indicator wheel, said first disabling mechanism being effective for preventing further rotation of said mainspring in response to said indicator wheel reaching a first predetermined angular rotation measure indicative of a first predetermined amount of winding in said mainspring.

34. The winding protection structure of claim 33 wherein said mechanical device further includes an energy-storing wheel train for applying a winding torque onto said mainspring;

said first predetermined angular rotation measure being indicative of an over winding condition wherein the amount of winding in said mainspring is not less than a first predetermined maximum amount.

35. The winding protection structure of claim 34 wherein said first disabling mechanism is further effective for disengaging said energy-storing wheel train from said mainspring and thereby preventing the application of said winding torque onto said mainspring.

36. The winding protection structure of claim 34 wherein said first disabling mechanism includes a lock lever and is further effective for engaging said lock lever with a gear train of said mainspring thus preventing additional rotation of said mainspring in the winding direction.

37. The winding protection structure of claim 33 wherein said mechanical device further includes a mechanical-load wheel train for drawing unwinding energy from said mainspring;

said first predetermined angular rotation measure being indicative of an under winding condition wherein the amount of winding in said mainspring is not greater than a second predetermined minimum amount.

38. The winding protection structure of claim 37 wherein said mechanical-load wheel train is coupled to a gear train of said mainspring and said first disabling mechanism further includes a lock lever for engaging said mechanical-load wheel train thus preventing further rotation of said mainspring in the unwinding direction.

39. The winding protection structure of claim 33 wherein said indicator wheel includes a rotation marker for indicating the amount of winding and unwinding in said mainspring.

40. The winding protection structure of claim 39 wherein said mainspring is restricted to a predetermined range of windings and the movement of said rotation marker corresponding to said predetermined range of windings is not greater than 360° of said indicator wheel.

41. The winding protection structure of claim 39 wherein the movement of said rotation marker on said indicator wheel corresponding to a winding range of said mainspring ranging from a predefined minimum unwound condition to a predefined maximum wound condition is not more than a 180° rotation of said indicator wheel.

42. The winding protection structure of claim 39 wherein said first disabling mechanism further includes a lock lever having a pivot arm sliding on said indicator wheel, said rotation marker including an engaging mechanism for actuating said lock lever as said rotation marker meets said pivot arm.

43. The winding protection structure of claim 42 wherein said engagement mechanism includes grooves on said rotation marker for grasping said pivot arm.

44. The winding protection structure of claim 42 wherein said engagement mechanism is a non-uniformity in the shape of said indicator wheel, the mating of said pivot arm with said non-uniformity resulting in a swinging action of said lock lever whereby further rotation of said mainspring is prevented.

45. The winding protection structure of claim 44 wherein said non-uniformity is one of a protrusion and an indentation on said indicator wheel.

46. The winding protection structure of claim 44 wherein said indicator wheel resides within an U-shape opening of said lock lever defined by said pivot arm and a pressure arm, said pivot arm and said pressure arm contacting opposites sides of said indicator wheel whereby said pressure arm causes said pivot arm to be pressure pressed against said against said indicator wheel.

47. The winding protection structure of claim 33 further having a second disabling mechanism responsive to said indicator wheel, said second disabling mechanism being effective for preventing further rotation of said mainspring in response to said indicator wheel reaching a second predetermined angular rotation measure indicative of a second predetermined amount of winding in said mainspring;

said mechanical device further including an energy-storing wheel train for applying a winding torque onto said mainspring, said first predetermined angular rotation measure being indicative of an over winding condition wherein the amount of winding applied to said mainspring by said energy-storing wheel train is not less than a first predetermined maximum amount;

said mechanical device further including a mechanical-load wheel train for drawing unwinding energy from said mainspring, said second predetermined angular rotation measure being indicative of an under winding condition wherein the amount of winding of said mainspring due to the unwinding action of said mainspring by said mechanical-load wheel train is not greater than a second predetermined minimum amount.

48. The winding protection structure of claim 47 wherein said mechanical-load wheel train is coupled to a gear train of said mainspring and said second disabling mechanism further includes an under-winding lock lever for engaging said mechanical-load wheel train thus preventing further rotation of said mainspring in the unwinding direction.

49. The winding protection of claim 48 wherein said first disabling mechanism is further effective for disengaging said energy-storing wheel train from said mainspring and thereby preventing the application of said winding torque on said mainspring.

50. The winding protection structure of claim 48 wherein said first disabling mechanism includes an over-winding lock lever for engaging with a gear train of said mainspring thus preventing additional rotation of said mainspring in the winding direction.

51. The winding protection structure of claim 50 wherein said indicator wheel includes a rotation marker for indicating the amount of winding and unwinding in said mainspring.

52. The winding protection structure of claim 51 wherein said mainspring is restricted to a predetermined range of windings and the movement of said rotation marker corresponding to said predetermined range of windings is not greater than 360° of said indicator wheel.

53. The winding protection structure of claim 51 wherein the movement of said rotation marker on said indicator wheel corresponding to a winding range of said mainspring ranging from a predefined minimum unwound condition to a predefined maximum wound condition is not more than a 180° rotation of said indicator wheel.

54. The winding protection structure of claim 50 wherein said under-winding lock lever and over-winding lock lever each include a respective pivot arm sliding on said indicator wheel, said rotation marker including an engaging mechanism for actuating said under-winding and over-winding lock levers as their respective pivot arms meet said rotation marker along said indicator wheel.

55. The winding protection structure of claim 54 wherein said engagement mechanism includes grooves on said rotation marker for grasping the pivot arm of said under-winding lock lever and the pivot arm of said overwinding lock lever.

56. The winding protection structure of claim 50 wherein said under-winding lock lever and said over-winding lock lever are part of a single dual action lock lever effective for engaging said gear train of said mainspring in response to said indicator wheel reaching said first predetermined angular rotation measure and effective for engaging said mechanical-load wheel train in response to said indicator wheel reaching said second predetermined angular rotation measure.

57. The winding protection structure of claim 56 wherein said dual action lock lever has a two-headed hammer configuration with a first head effective for engaging said gear train of said mainspring and a second head effective for engaging said mechanical-load wheel train.

58. The winding protection structure of claim 50, wherein said under-winding lock lever and over-winding lock lever each include a respective pivot arm sliding on said indicator wheel, said rotation marker including an engaging mechanism for actuating said under-winding and over-winding lock levers as their respective pivot arms meet said rotation marker along said indicator wheel, said engagement mechanism being a non-uniformity in the shape of said indicator wheel, the mating of a pivot arm with said non-uniformity resulting in a swinging action of the pivot arm's respective over-winding lock lever and under-winding whereby further rotation of said mainspring is prevented.

59. The winding protection structure of claim 58 wherein said non-uniformity consists of a protrusion for actuating said under-winding lock lever and an indentation for actuating said over-winding lock lever.

60. The winding protection structure of claim 59 wherein said under-winding lock lever and said over-winding lock lever are part of a single dual action lock lever having a single pivot arm residing on said indicator wheel, said dual action lock lever being effective for engaging said gear train of said mainspring in response said single pivot arm mating with said indentation and effective for engaging said mechanical-load wheel train in response to single said pivot arm mating with said protrusion.

61. The winding protection structure of claim 56 wherein said dual action lock lever has a two-headed hammer configuration with a first hammer head being effective for engaging said gear train of said mainspring and a second hammer head being effective fore engaging said mechanical-load wheel train.

62. The winding protection structure of claim 60 wherein said indicator wheel resides within an U-shape opening of said dual-action lock lever defined by said single pivot arm and a pressure arm, said single pivot arm and said pressure arm contacting opposites sides of said indicator wheel whereby said pressure arm causes said single pivot arm to be pressure pressed against said indicator wheel.

63. The winding protection structure of claim 33 wherein said mechanical device includes one of a manually and an automatically actuated energy-storing wheel train for applying a winding torque onto said mainspring.

64. A timepiece comprising:

a mainspring that accumulates energy through actuation of a winding-up portion;

a primary wheel train coupled to said mainspring;

a hand connected to said primary wheel train;

an addition-and-subtraction wheel train driven by addition and subtraction of accumulated energy corresponding to an amount by which the mainspring is wound up and unwound, respectively;

an addition-and-subtraction wheel, disposed in said addition-and-subtraction wheel train, that rotates in correspondence with an amount by which the mainspring is wound up and unwound, said addition-and-subtraction wheel having a single plane of rotation and being rotatable about a stationary axis; and one of a winding-up lock mechanism that locks said winding-up portion to stop the winding up of said mainspring when said mainspring is wound up to a number of windings that is equal to or greater than a first predetermined number of windings, and an unwinding lock mechanism that locks the primary wheel train to stop hand movement when said mainspring is unwound to a number of windings that is equal to or less than a second predetermined number of windings.

65. A method of controlling a winding-up operation of a mainspring device having a mainspring coupled to a wheel train, said method comprising:

rotating an indicator wheel within a single rotation plane and along a stationary axis in accordance with the amount of winding applied to the mainspring;

winding-up the mainspring with a winding-up portion to a number of windings that is equal to or greater than a predetermined number of windings to accumulate energy in the mainspring, and when said indicator wheel indicates that the number of windings is equal to or greater than the predetermined number of windings, locking the winding-up portion with a winding-up lock mechanism in order to stop the winding up of the mainspring.

66. A method of controlling an unwinding operation of a mainspring device having a mainspring coupled to a wheel train, said method comprising:

rotating an indicator wheel within a single rotation plane and along a stationary axis in accordance with the amount of unwinding applied to the mainspring;

unwinding the mainspring to a number of windings that is equal to or less than a predetermined number of windings, and when said indicator wheel indicates that the number of windings is equal to or less than the predetermined number of windings, locking the wheel train with an unwinding lock mechanism in order to stop the rotation of the wheel train.

67. A winding protection structure for a time piece having a mainspring, said winding protection structure comprising:

an indicator wheel having a single plane of rotation, being rotatable about a stationary axis, and being responsive to the winding and unwinding of said mainspring, said indicator wheel having a first directional rotation proportional to the winding of said mainspring and having a second directional rotation proportional to the unwinding of said mainspring, said first directional rotation being opposite said second rotational direction;

a first disabling mechanism responsive to said indicator wheel, said first disabling mechanism being effective for preventing further rotation of said mainspring in response to said indicator wheel reaching a first predetermined angular rotation measure indicative of a first predetermined amount of winding in said mainspring.

* * * * *